United States Patent [19]

Anahara et al.

[11] 3,969,885

[45] July 20, 1976

[54] METHOD FOR MANUFACTURING A TEXTURED YARN

[75] Inventors: Meiji Anahara, Kyoto; Yukio Kawasaki, Takatsuki; Yasuo Suzuki, Gifu, all of Japan

[73] Assignee: Toyo Boseki KK, Osaka, Japan

[22] Filed: Nov. 27, 1974

[21] Appl. No.: 527,768

[30] Foreign Application Priority Data

Dec. 6, 1973 Japan ..... 48-139136

[52] U.S. Cl. ..... 57/157 R; 57/6; 57/34 R; 57/140 R; 57/144; 57/160

[51] Int. Cl.[2] ..... D02G 3/00; D02G 3/36

[58] Field of Search ..... 57/3, 12, 6, 34 R, 59, 57/140 R, 144, 160, 162, 157 R, 164

[56] References Cited

UNITED STATES PATENTS

| | | | |
|---|---|---|---|
| 3,312,052 | 4/1967 | Shiranezawa et al. | 57/157 R |
| 3,358,436 | 12/1967 | Niina et al. | 57/162 |
| 3,477,219 | 11/1969 | Williams | 57/157 R X |
| 3,482,389 | 12/1969 | Kondo et al. | 57/157 R |
| 3,487,627 | 1/1970 | Cannon et al. | 57/140 R |
| 3,535,867 | 10/1970 | Cannon et al. | 57/34 R |
| 3,657,871 | 4/1972 | Uchiyama et al. | 57/34 R |
| 3,685,268 | 8/1972 | Seguin | 57/160 X |

*Primary Examiner*—John Petrakes
*Attorney, Agent, or Firm*—Wenderoth, Lind and Ponack

[57] ABSTRACT

A method for manufacturing a textured yarn from an artificial multi-filament yarn consisting of a plurality of continuous mono-filaments, by folding up the mono-filaments in multiple layers and entwining them by genuine twists to form a textured yarn which has the appearance, touch and texture resembling a spun yarn. The process is made up of the steps of spreading into individual filaments a continuous multi-filament yarn of artificial fiber, passing part or all of the spread-out filaments onto the periphery of a rapidly-rotating spindle of a conical or cylindrical shape, assembling the filaments around the spindle in the form of a sleeve constituted by thin filament layers, and continuously withdrawing the sleeve from the spindle at a speed which is lower than the feed speed of the multi-filament yarn, the sleeve being withdrawn either in a straight forward direction along the spindle axis or in a backward direction through an axially-extending passage in the spindle after being everted at the nose thereof. Alternatively, an additional yarn may be introduced as a core thread into the sleeve while it is being withdrawn from the spindle, which also results in a core yarn which has the appearance, handling and texture resembling a spun yarn.

24 Claims, 45 Drawing Figures

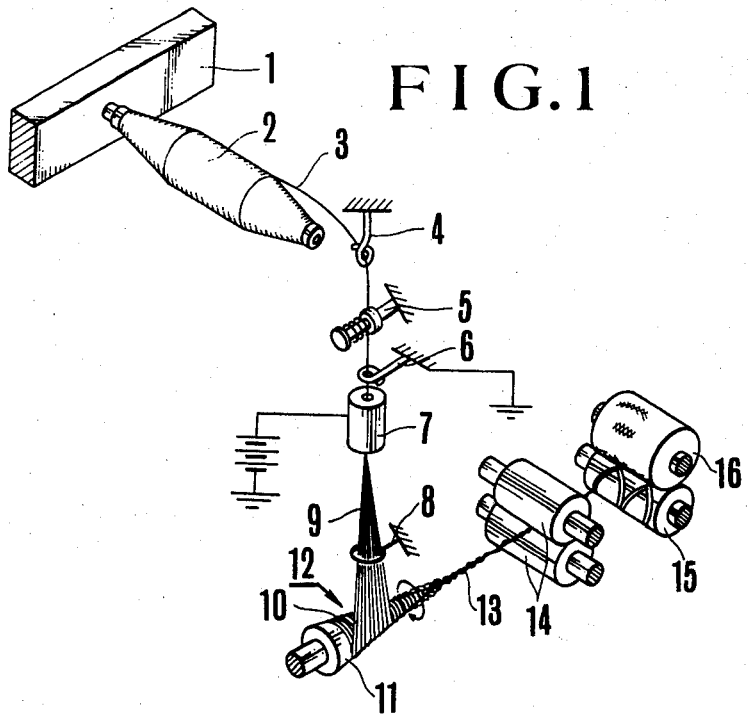
FIG.1
FIG.2
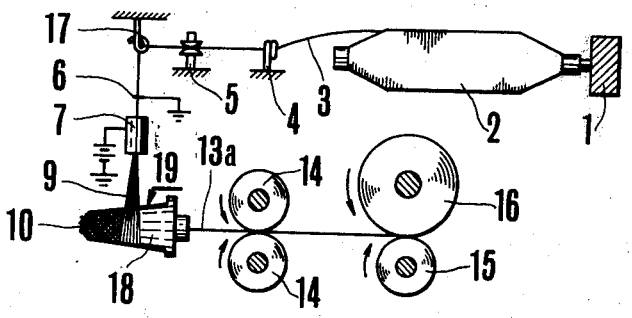

METHOD FOR MANUFACTURING A TEXTURED YARN

BACKGROUND OF THE INVENTION

This invention relates to a process for manufacturing a textured yarn from a continuous multi-filament yarn of artificial fiber, where the individual component filaments are aligned substantially parallel to the longitudinal axis of the yarn with complicated loops and entaglements and entwined by genuine twists to form a structure resembling a spun yarn in appearance, texture and handling. This invention furthermore relates to a process for manufacturing a core yarn having a core thread enveloped in a sheath of a textured yarn as just described to give the appearance, texture, and handling resembling a spun yarn.

A typical method for manufacturing a yarn of this type is disclosed in the specification of British Pat. No. 1,082,401 wherein a single freshly formed continuous filament is extruded through an orifice in a spinneret at room temperature and, after cooling and solidification, is wrapped around the surface of a truncated cone under the guidance of a traverse mechanism which is located in a short distance above the cone surface. As a result of the reciprocating movement imparted to the filament, it is wound back and forth across the surface of the conical godet as a series of interconnected helicies, which accumulate thereon in the form of a tapered sleeve. The sleeve while being propagated by the wrapping of the continuously advancing filament is progressively pulled down in the inclined surface of the godet in the direction of its axis of rotation by means of a conventional winding arrangement.

The inventors of British Pat. No. 1,082,401 have proposed another method in British patent specification No. 1,102,095, wherein a continuous filament is wrapped around the surface of a truncated cone in the same manner as in British Pat. No. 1,082,401 just discussed, the truncated cone having an axially extending passage. Through the reciprocating movement imparted to the filament, the filament is wound around the surface of the conical godet as a series of interconnected helicies, which accumulates thereon in the form of a tapered sleeve. The sleeve while being propagated by the wrapping of the continually advancing filament is progressively pulled down the inclined surface of the godet in the direction of its axis of rotation. At the converging end of the conical godet, the sleeve is pulled in a reverse direction through the axially extending passage in the godet, everting the sleeve, and transferring the relatively short loops which project outward from the main mass of the sleeve from the periphery to the interior.

British patent specification No. 1,158,602 describes the production of a core yarn which applies the methods disclosed in the afore-discussed British patent specification Nos. 1,082,401 and 1,102,095, wherein an additional yarn is supplied as a core strand to the forward end of the godet to join a sleeve which is continuously withdrawn and collected as a core yarn with a composite structure.

The core yarn so obtained has a centrally disposed core thread and a wrapping component constituted by one or more continuous filaments in the form of serially-connected, essentially axially extending loops arranged so that they progressively advance along the axis and helically twist around and completely envelop the core strand.

In any of the prior-art methods described above, a freshly spun continuous yarn is passed to the surface of a conical godet around which the filament is wound under the guidance of a high-speed traverse mechanism. Currently known high-speed traverse mechanisms have complicated structures and are difficult to maintain. Furthermore, they have upper limits to their reciprocating speed, which in turn place limits on the utility of the three methods. If the peripheral surface of a godet is increased without an accompanying increase in the reciprocating movement, for instance, the angle at which filaments lie in relation to each other on the godet surface as well as entanglements among the filaments will decrease and withdrawal of the sleeve will become more difficult and the irregularity of the yarn will increase.

In these prior-art methods, furthermore, the ratio of the peripheral speed of the godet to the speed of sleeve withdrawal, or the doubling number must be quite large, that is, approximately 100 or over, in order to maintain sufficient twists in the yarn. Therefore, a continuous filament which is supplied to the godet must have a thickness on the order of approximately one-hundredth of that of the yarn to be collected, imposing a limitation on the productivity of such a filament and pushing up the cost of the same. In the conventional methods, the freshly formed continuous filament is passed directly to a rapidly rotating godet with such an economic factor in mind. Nevertheless, the arrangement does not overcome the basic drawback that the productivity of the method of manufacture of such a continuous filament is low.

It is also well known in the art that the continuous filament in the conventional methods usually undergoes insufficient drafting and thus has low strength, excess ductility and residual shrinkage.

The prior art methods have an additional drawback in that, because of the particular manner in which the continuous filament is supplied, the filament must necessarily be a meltspinning type and the choice of materials for the filament is quite limited.

SUMMARY OF THE INVENTION

Objects of the Invention

The invention has for one of its objects the provision of a method for manufacturing a textured yarn which disposes of the need for a high-speed traverse mechanism, by dividing or spreading out a substantially non-twist continuous multi-filament yarn of artificial fiber into individual filaments and passing the spread-out filaments so obtained onto the periphery of a rotating spindle around which the filaments are wound in such a manner as to simultaneously cause spontaneous and random traverse movements of the individual filaments in the course of their passage onto the spindle surface, in utilization of migrations among the individual filaments.

The invention has for another object the provision of a method for manufacturing a textured yarn with a construction wherein filaments are arranged in the form of a network of axially extending loops with complicated entanglements among the method including the steps of progressively superposing thin layers of continuous filaments of an artificial multi-filament yarn on the spindle in the form of a tubular sleeve and continuously withdrawing the sleeve so obtained from the spindle in a forward direction along the spindle axis or in an opposite direction through an axially extending passage contained in the spindle, at a speed lower than the feed speed of the continuous multi-filament yarn.

Another object of the invention is to provide a method for manufacturing a core yarn which has the appearance, texture and handling resembling a spun yarn, the method comprising the steps of superposing thin layers of continuous filaments on a rotating hollow spindle in the form of a tubular sleeve, introducing an additional yarn as a core strand within the sleeve, enwrapping the core strand within the sleeve, continuously withdrawing the core strand and the sleeve in association therewith at a speed lower than the feed speed of the continuous filaments, and collecting the core yarn so obtained in an orderly manner.

Still another object of the invention is to provide a method for manufacturing a textured yarn which allows use of a continuous multi-filament yarn in the process of manufacture, the method including the steps of spreading a continuous multi-filament yarn into individual continuous filaments and passing the individual filaments so obtained onto the spindle surface while simultaneously allowing the individual filaments of their passage onto the surface and still guiding the filaments as a whole to enwrap the spindle surface in a substantially uniform and regular manner.

It is a further object of the invention to provide a method for manufacturing a textured yarn which enables a reduction of the doubling number and thus a reduction in the production cost of a yarn of a given thickness by allowing use of a less expensive medium denier multi-filament yarn as raw material. Here, the term "doubling number" refers to the ratio obtained by dividing the feed speed of a continuous multi-filament yarn by the speed at which a tubular sleeve formed on the spindle is continuously withdrawn and indicates the degree of overlapping of the continuous multi-filament yarn. The feed speed of a multi-filament yarn may be obtained from the peripheral speed of feed rollers when the rollers nippingly feed the yarn. Otherwise, the feed speed of the yarn is controlled by the peripheral speed of the spindle. In the latter case, the peripheral speed of the spindle may be substitute for the feed speed in the calculations.

It is a still further object of the invention to provide a method for manufacturing a textured yarn, wherein a plurality of continuous filaments are simultaneously passed to the spindle and wound around the spindle in a network of very closely entangled filaments, thereby to facilitate the smooth withdrawal of a sleeve when the doubling number is small and to enable efficient production of a textured yarn with less unevenness.

Another object of the invention lies in the provision of a method for manufacturing a textured yarn, wherein a medium denier continuous multi-filament yarn of an artificial material may be used as the source of raw filaments and accordingly the peripheral speed of the spindle may be chosen within a much wider range unlike in the conventional processes where the requirement that the raw material must be a freshly spun continuous filament puts a limit on the present invention, there is imposed no restriction on the peripheral speed of the spindle such as that demanded for molecular orientation of a freshly extruded yarn. Therefore, it is possible to reduce the spindle diameter and increase the rotational speed of the spindle, thereby to increase the genuine twists imparted to a tubular sleeve which is being withdrawn. This contributes not only to an improvement in the yarn stability under tension and squeezing but also to a reduction in the doubling ratio which makes possible an increase of the take-up speed.

Still another object of the invention lies in the provision of a method for manufacturing a textured yarn, wherein only part of the spread-out filaments of a multi-filament yarn are passed onto and wound around the rotating spindle while the remainder of the filaments are passes to a space just in front of the spindle thereby to reduce the number of filaments which form a sleeve on the spindle, to facilitate smooth withdrawal of the sleeve, and to make possible improvements in the regularity of the yarn so obtained and the stability of production. A spindle which is adaptable for use in the method just described does not have to be conical and may be cylindrical which allows a higher precision in the fabrication of the spindle.

A still further object of the invention lies in the provision of a method for manufacturing a textured yarn wherein the spreading or dividing of the continuous multifilament yarn into individual filaments is effected by either an electrical or a pneumatic system using a low pressure and/or low volumetric fluid flow and is free of any mechanically movable parts, thereby to make possible a high-speed production.

Summary of the Invention

This invention relates a method for manufacturing from a multi-filament yarn a textured yarn which resembles a spun yarn in appearance, texture and handling, the method comprising the steps of continuously passing a substantially non-twist continuous multi-filament yarn of artificial fiber into individual mono-filaments, by a dividing or spreading means, passing at least part of the spread-out filaments onto the periphery of a rotating spindle while simultaneously allowing spontaneous changes of positions among the individual filaments in the course of their passage to the spindle under the influence of the raw twists and/or twists given to the filaments when being unwound from a package and/or of migration among the filaments, but guiding the filaments as a whole to form a bundle of substantially uniformly distributed filaments, at least part of which filaments fall on the spindle, assembling the filaments around the spindle in the form of a sleeve of superposed filaments, continuously withdrawing the sleeve from the spindle at a speed lower than the feed speed of the multi-filament yarn, the sleeve being withdrawn either in a straight forward direction along the spindle axis or in a forward direction up to the spindle nose and then in an opposite direction through an axially-extending passage of the spindle to evert the sleeve at the nose of the spindle.

The term "a continuous multifilament yarn of artificial fiber" as used throughout the specification and the appended claims refers to a continuous yarn of synthetic fiber, semisynthetic fiber or regenerated fiber, but not of natural fiber, and comprises a plurality of continuous mono-filaments. The filaments may be straight, curled or of any other configuration and may be of any cross-sectional shape. For the purpose of the present invention nevertheless straight filaments are preferable in that they are more easily divided or spread apart. Suitable multi-filament yarns for use in the process of the invention include substantially all of the yarns used for ordinary garments as well as some of the intermediate products which are not suitable for garment-purposes because of insufficient strength or excessive ductility, for instance. Examples of such intermediate yarns are undrawn yarns, partially oriented yarns and partially drawn yarns. Specifically, continuous multi-filament yarns suitable for use in fabrication of a textured yarn according to the method of the invention may be of a polyamide, polyester, acrylic substance, cupra, rayon, acetate, Polynosic (viscose rayon fiber), triacetate, protein-acrylonitrile copolymer, benzoate, Vinylon (polyvinylalcohol fiber), polyvinyl chloride, polyethylene, or a polyvinylidene chloride. An exception is a yarn of such material as a polyurethane which has excessive ductility and which is difficult to separate into individual filaments under ordinary circumstances. A continuous multi-filament yarn for the present process should preferably have 10 or more filaments to facilitate substantially uniform distribution of part or all of the filaments on the spindle surface. The number of filaments in a yarn, on the other hand, is preferably under 50 because otherwise positional interchange among the filaments in the course of their passage to the spindle is hindered. For the purpose of this invention, the term "substantially non-twist" refers to the original twist level in a raw yarn of less than 50 twists/meter, and preferably under 20 twists/meter. With a number of twists over 50 twist/meter, spreading of the individual filaments will become insufficient with the result that the regularity of the product will be unsatisfactory and a smooth operation will be impossible. With a number of twists less than 50 twists/meter, and preferably under 20 twists/meter, a continuous multi-filament yarn can be easily divided into individual filaments by a suitable apparatus. By the migration among the filaments, coupled with the raw twists just discussed, the individual filaments will continuously exchange positions in the course of their passage onto the spindle, and upon reaching the spindle; will wrap the spindle surface in thin layers of substantially uniformly distributed filaments. Due to the spontaneous and random nature of the positional interchange, furthermore, each filament will assume an unpredictable position during its travel and on the spindle at any given time and thus the layers of filaments on the spindle will have a network of closely-intermingled filaments with entanglements of a complicated nature. As a result, the filaments will maintain a sufficient entanglement and hence good resistance for external stretching and abrading forces even when the doubling number, or the degree of multi-filament yarn superposition, is reduced to below 20 or even 10. The doubling number must be over 3, as otherwise there will not be enough twists to entwine the textured yarn expecially under any external stress.

Generally, only one multi-filament yarn is supplied to the spindle surface. However, it is possible to impart to the textured yarn of the invention a varied function as well as appearance by supplying to the spindle two or more multi-filament yarns with different dyeing characteristics, absorbance, Young's modulus, tenacity, ductility, cross-sectional areas, deniers of mono-filaments, brightness, configuration and appearance. When two or more multi-filament yarns are to be introduced onto a spindle, they may be passed through a single common spreading apparatus. However, in such a case, the total number of filaments tends to exceed a desirable limit and there may also be a tendency for the filaments of the different yarns to interact upon contact to hinder normal separation. Therefore, it is generally desirable to provide a separate spreading apparatus for each multi-filament yarn in order to ensure uniform filament division and in turn to obtain a good regularity in the product. Although there is no restriction on the type of spreading apparatus which is to be used in the method of the invention, an electrical system or a pneumatic system which uses a low-pressure fluid is preferable because of their ability to spread the cintinuously advancing multi-filament yarn into individual filaments without causing disturbance or entanglements of the filaments, a particularly suitable example of such a system being the method and apparatus as disclosed in U.S. Pat. No. 3,657,871. A textured yarn of satisfactory quality is obtainable by passing and winding all of the spread-out filaments around the periphery of the spindle, although the spreading procedure is susceptible to a number of variations. In another embodiment of the invention, only part of the spread-out filaments are passed onto the spindle, the remainder being passed to a space just in front of the spindle nose in a manner as if to enwrap a rotating imaginary spindle thereat. By so doing, it is generally possible to further improve the regularity, as well as the uniformity of other qualities of the product and also to boost the efficiency of the process.

When part of the filaments are passed to a space in front of the spindle, such filaments will directly enwrap any yarn which happens to be there, namely, a sleeve being withdrawn in the axially forward direction from the spindle nose or a core thread being supplied to the nose, if there is one. In the absence of such a yarn, the filaments will proceed to the spindle nose to join the sleeve which has been formed on the spindle surface by the remainder of the filaments, and will become a core region of the textured yarn, enveloped in the sleeve which serves as a sheath. For use in this embodiment, the spindle can be not only conical in shape with a tapered surface but also cylindrical in shape with a surface inclination of 0°. A spindle beving a cylindrical shape has an advantage over its conical counterpart in that it is easier to fabricate with high precision.

For the textured yarn which is manufactured according to the invention to maintain sufficient stability against stretching and abrading, it should be given twists depending upon the denier of the yarn, for example, in the range of 200 to 600 twists/meter, when the denier of the yarn falls in the range 200 to 800. The twists to be imparted to the product yarn are ordinarily controlled by two factors: the withdrawal speed and the spindle diameter. By reducing spindle diameter, it will become possible to increase the twists to be imparted to the yarn, or alternatively to boost the take-up speed of the yarn. Therefore, the spindle should have as small a diameter as possible, a suitable choice for the diameter being not more than 25 mm, or more preferrably under 10 mm, measured at the maximum diameter portion of the spindle excluding a flange, if any. A smaller diameter spindle has less weight and makes possible a higher spindle rotation speed, thus increasing the productivity. When the spindle has a conical shape, its surface inclination should not be more than 15°, and preferably under 4°, in order to prevent slack in the conical tubular sleeve and to avoid hinderance to the smooth withdrawal of the same, the slack otherwise forming a filament balloon under the influence of centrifugal force.

In another embodiment of the invention, an additional yarn is introduced into the sleeve as a core thread or core strand and the sleeve is wrapped therearound to form a core yarn which has the appearance, texture and handling of a spun yarn. This embodiment which incorporates a core thread is superior to the embodiment which uses only a continuous multi-filament yarn, from the viewpoint of uniformity in the yarn quality and stability of the production process. In the process where the sleeve which has been formed on the spindle surface is everted at the spindle nose and continuously withdrawn through an axially extending passage in the backward direction, and a core thread is supplied within the sleeve at the spindle nose at an angle of less than 90° with respect to the direction of withdrawal of the product yarn, that is, the sleeve. In such an arrangement, the core thread will frictionally contact and effectively control the growth of a balloon which mostly develops at the spindle nose, and will guide the eversion and withdrawal of the balloon in association with the rest of the sleeve, and thus will significantly enhance the production reliability and efficiency as well as the yarn quality.

A balloon essentially comprises filament loops which, entangled with each other, project radially outwardly from the surface or the nose of the spindle substantially in a corona-shape under the influence of centrifugal force. Another method for controlling this phenonmenon, which will otherwise interfere with smooth withdrawal of the filaments, is to position a balloon controller of a suitable shape closely adjacent the forward end of the spindle. The balloon controller effectively checks the balloon by making physical contact therewith and suppressing the growth of the same. The device, however, cannot be used in a process where some of the filaments are passed to the space in front of the spindle because the device will be ineffective if positioned in any other location.

The above and other objects, features and advantages of the invention will become clear from the following particular description of the invention and the appended claims, taken in conjunction with the accompanying drawings which show by way of example preferred embodiments of the present invention.

BRIEF DESCRIPTION OF THE DRAWINGS

In the accompanying drawings:

FIG. 1 is a schematic perspective view illustrating a method according to the present invention, in which a continuous multi-filament yarn of artificial fiber is spread into individual filaments, enwrapped in its entirety around the periphery of a rotating conical spindle, withdrawn from the nose of the spindle and collected by a wind-up means;

FIG. 2 is a schematic end view illustrating another embodiment of the invention, in which the spread filaments are passed to and wound around the periphery of a rotating hollow conical spindle, everted at the nose of the spindle, withdrawn axially backward through an axially extending passage through the spindle and collected by a suitable wind-up means;

Figure 3A:
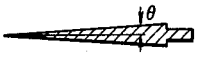
FIGS. 3*a* to 3*v* are cross-sectional views of rapidly rotatable spindles of various shapes, which may be employed in the method of the invention.
Figure 3B:
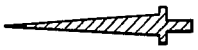
Figure 3C:
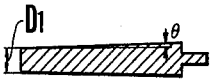
Figure 3D:
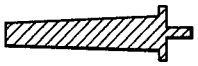
Figure 3E:
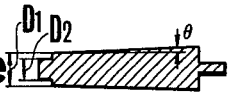
Figure 3F:
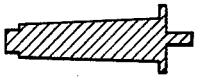
Figure 3G:
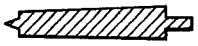
Figure 3H:
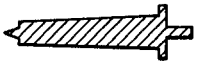
Figure 3I:
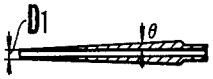
Figure 3J:
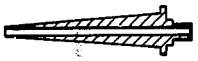
Figure 3K:
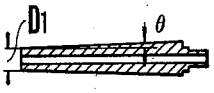
Figure 3L:
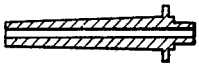
Figure 3M:
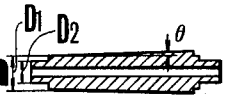
Figure 3N:
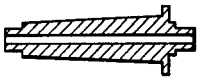
Figure 3O:
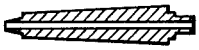
Figure 3P:
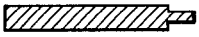
Figure 3Q:
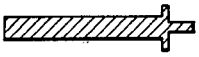
Figure 3R:
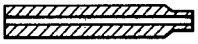
Figure 3S:
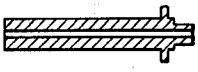
Figure 3T:
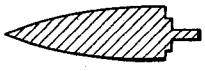
Figure 3U:
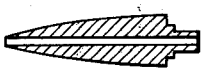
Figure 3V:
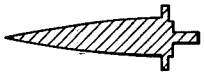

PARTICULAR DESCRIPTION OF THE INVENTION:

The method for manufacturing a textured yarn according to the invention will now be described with reference to the various embodiments shown in the accompanying drawings. Referring first to FIG. 1, a substantially non-twist continuous multi-filament yarn 3 of synthetic or artificial fiber is drawn off a package 2 which is supported on a beam 1, and passed through a pigtail guide 4, a tensioning device 5 and another pigtail guide 6 to an electric filament spreading means 7 which is adapted to divide or spread the multi-filament yarn 3 into a bundle 9 of individual filaments. The bundle 9 is then passed through a guide 8 where the width of the bundle is adjusted to an approximately predetermined dimension, the entire filament bundle 9 subsequently being passed onto and wound around the periphery 11 of a conical spindle 12 substantially in a thin-layer form. The spindle 12 is rotatingly driven by a suitable drive mechanism (not shown). The filaments are assembled on the tapered surface 11 of the conical spindle 12 in the form of a network of accumulatingly superposed filament layers, herein referred to as a conical tubular sleeve 10 for convenience. The sleeve 10 is continuously withdrawn along the axis of rotation of the spindle, sliding down along the tapered surface 11, toward the nose of the spindle by the pulling action of a pair of nip rollers 14 at a speed slower than the feed speed of the continuous multi-filament yarn 3. In the course of the withdrawal, the individual filaments which constitute the sleeve 10 stretch in the axial direction to form elongated loops with longitudinal lengths which are several to several tens of times the spindle circumference. The withdrawn filaments are collected as a textured yarn 13 of a complicated structure with numerous entanglements among filaments and with numerous loops projecting from the yarn periphery. The textured yarn 13 is given a reciprocating traverse movement by a split drum 15 and wound in a package 16 which is in contacting engagement with the drum 15 and rotatingly driven by the same.

Various mechanical, pneumatic and electrical apparatus may be used as the filament spreading means 7. For the purpose of the invention, it is important that the spreading means reliably divides or spreads a multi-filament yarn into a substantially uniform bundle of mono-filaments without any abrupt action which may result in irregular distribution of the filaments or any undesirable entaglements thereof. Considering such a requirement, an electrical system or a pneumatic unit involving ejection of a relatively low pressure and/or low volumetric fluid flow is particularly suitable. Especially worthy of note is an electrical system disclosed in U.S. patent specification No. 3,657,871, in which a potential of 500 volts or over is imposed between two electrodes which are positioned in staggered relation with respect to the path of travel of the filaments. In such an apparatus, the filaments are passed through and contacted with the first electrode and are charged to a like polarity and will progressively spread apart during and after their passage to the second electrode under the influence of the electrostatic repulsion among the filaments and the attraction thereof by the second electrode. Practical examples, which use as a spreading means a pneumatic unit alone or in combination with an electrical system will be discussed hereinafter.

A continuous multi-filament yarn of artificial fiber which is supplied from a package invariably possesses so-called raw twists and/or twists given at the time of unwinding from the package and/or the migration among the individual filaments. In a freshly formed yarn which has not been wound in a package, twists are not present. In the latter, however, individual filaments migrate with respect to each other during oiling, drawing, heat treatment or forced feeding by feed rollers. In either case, the position of each filament in the filament bundle, while being passed onto the periphery of the rotating conical spindle, continuously changes and thus the position into which the filament moves on the spindle varies over the course of time accordingly. As a result, each filament independently and randomly traverses to-and-fro on the spindle surface during the enwrapping process, while the filaments as a whole spread substantially uniformly over the spindle surface. In the method it is of primary importance that the continuous multi-filament yarn has a substantially non-twist characteristic to ensure that it is spread out into individual filaments by the action of the suitable spreading unit. Here, the term "substantially non-twist" refers to a raw twists level of less than 50 twists/meter, and preferably under 20 twists/meter. Any multi-filament yarn having raw twists of over 50 twists/meter tends to have an excessively strong interaction or interference among the individual filaments and even if spreading of the filaments were possible, the spreading will be irregular and unstable which results in uneven and unsatisfactory yarn quality. A continuous multi-filament yarn which is unwound and free of raw twists, such as a freshly formed multi-filament yarn, engenders inter-migration of individual filaments during the yarn forming and subsequent steps such as the entwining of the filaments, oiling and the active feeding by godet rollers as just discussed. Thus, the changes of positions among individual filaments do take place, although the rate of such changes is relatively low. When a freshly formed yarn is used as the input yarn, a spreading apparatus which comprises a suction nozzle producing a low pressure and/or small volumetric fluid flow of a nature to be discussed later will be more suitable than the electric apparatus in that the changes of positions among the individual filaments are further enhanced. When a continuous multi-filament yarn is forcibly fed by the action of feed rollers, furthermore, provision of a suction nozzle is usually required for preventing sticking of the yarn filaments around the rollers. A suitable width of the spread of the filaments depends on such factors as the denier of the particular multi-filament yarn, the number of filaments in the yarn, the effective length of the spindle which receives the filaments, and whether or not all of the filaments are to enwrap the spindle surface. An example where only part of the filaments are wound around the spindle will be described later. The suitable width, however, will usually be in the range of 5 to 70 mm, a somewhat narrower range of 5 to 50 mm being applicable in the case as shown in FIG. 1 where all of the filaments of the multi-filament yarn are passed onto and wound around the spindle.

The tensioning device 5 shown in FIG. 1 may be of any construction suitable for applying a tension of approximately 0.01 gram/denier to a yarn passing therethrough, some examples of such a device being a tension washer, a tension gate, and a magnetic tensioner. A common method for continuously feeding a yarn at a predetermined speed will be to use paired nip rollers which drivingly feed the yarn. When the combination of an electric filament spreading apparatus and a conical spindle is employed as in FIG. 1, the use of nip rollers for the purpose of feeding a continuous multi-filament yarn at a predetermined speed should preferably be avoided. This is because it is extremely difficult to synchronize the yarn feeding rate precisely with the peripheral speed of the spindle when nip rollers are used. Any excessive tension in the multi-filament yarn prevents desirable filament spreading while a lack of tension results in such troubles as sticking of the filaments around the nip rollers.

The pigtail guide 6 as shown in FIG. 1 should preferably be grounded electrically in order to maintain the continuous multi-filament yarn 3 which contactingly passes therethrough in an electrically neutral state. The guide 8 is adapted to control the width of the filament bundle 9, which has been formed by spreading apart the individual filaments of the continuous multi-filament yarn 3, and to help supply the bundle 9 onto a predetermined area on the spindle surface. The provision of the guide 8 is not absolutely necessary, although its provision usually improves the denier regularity of the product and it is also desirable for operational considerations. The guide 8, when used, should be electrically insulated to prevent any leakage of charges from the filament bundle 9 which has been electrically charged to a high potential.

Referring to FIG. 3, the angle of surface inclination $\theta$ of the rotating conical spindle 12 should not exceed 15°. When this inclination is exceeded, the peripheral speed of the spindle will vary excessively from one end of the spindle to another. As the continuous multi-filament yarn is delivered at a rate which is synchronized with the maximum peripheral speed of the spindle, the filaments which are wound around the spindle in the vicinity of the nose of spindle tend to be loose, often forming a filament balloon near the nose. Such a phenomenon causes irregularities of the product, and hinders a proper propagation of the filament sleeve along the spindle surface, which in turn reduces the operating efficiency. A large inclination angle $\theta$ also causes the filaments which are wound around the maximum diameter portion of the spindle to immediately slide down to the smaller diameter portions, that is, toward the nose of the spindle. The sliding results in an unstable and substantially smaller effective spreading width of the filaments at the spindle despite otherwise efficient spreading action of the spreading device. A reduction in the effective spreading width will decrease and make unstable the yarn wrapping speed, which in turn causes deterioration of the regularity of the product. A desirable inclination angle $\theta$ will be under 4° in order to stabilize the wrapping position of the spread filaments on the spindle surface, and to ensure suitable positional interchange among the individual filaments of the filament bundle, that is, to facilitate smooth and random traverse of the individual filaments. This ensures smooth and continuous withdrawal of a uniform filament sleeve toward the nose of the spindle, as well as efficient and reliable production of a yarn of a uniform quality. Likewise, a spindle which is adapted to receive all of the spread filaments thereon must have a substantially conical shape with a tapered surface which has an inclination $\theta$ of at least 1°, and preferably in the range of 2° to 4°, to ensure smooth withdrawal of the sleeve toward the nose of the spindle. Suitable shapes for the spindle will include a cone, truncated cone, truncated cone having at the nose thereof a projection of a smaller diameter, and any of the shapes just described but having at the maximum diameter portion thereof a flange to prevent slippage of the filaments in the backward direction. Some examples of such shapes are shown in cross section in FIGS. 3*a* to 3*h*, 3*t* and 3*v*. The term "maximum-diameter portion" as used in this specification refers to that portion of the spindle, excepting the flange portion, which receives the filament wrapping and has the maximum diameter. The contour line of the spindle may either be straight, arcuate, or a combination of both as long as the line tapers toward the nose and the tangent lines have an average inclination angle $\theta$ which falls in the just defined range of not more than 15°, and preferably between 2° and 4°. The spindle may be made of any solid material which resists wear, withstands high speed rotation and has a low friction coefficient (0.5 or less) to facilitate smooth withdrawal of the tubular sleeve from the spindle surface. Examples of such materials include metals, plastics, ceramics, jewels and glass.

Now referring to FIG. 2 which shows another embodiment of the invention, where like reference numerals are used to designate like parts, the continuous multi-filament yarn 3 of synthetic fiber is released from the package 2 which is supported by the beam 1 and led through the pigtail guide 4, the tensioning device 5, another pigtail guide 17 and through the electrically grounded pigtail guide 6 to the electric filament spreading apparatus 7 which is adapted to spread the yarn 3 into the filament bundle 9. The entire filament bundle 9 is passed to a surface 18 of a hollow truncated conical spindle 19, which has therein an axially extending passage, to windingly wrap the same. The conical tubular sleeve 10 of the filaments on the spindle is continuously withdrawn toward the nose of the spindle, and turned inside out at the nose and pulled in the backward direction through the passage in the spindle by the pulling action of the paired nip rollers 14. The sleeve is subsequently collected as a textured yarn 13*a* and is wound on a package 16 which is in contacting engagement with the co-rotating drum 15 which includes a traverse mechanism.

The spindle 19 has therein an axially extending passage with a diameter in the range of 0.8 to 4mm for the purpose of withdrawing the yarn therethrough. Suitable shapes for the spindle 19 include a cone, truncated cone, truncated cone having at the converging end or the nose thereof a stepwise projection with a smaller diameter, and any of the shapes just given but having at the maximum diameter portion thereof a flange. The contour line of a suitable spindle may be straight, arcuate or a combination of both and the average inclination should be not more than 15°, and more preferably should be in the range of 2° to 4°. Some examples of suitable shapes for the spindle 19 are shown in cross section in FIGS. 3*i* to 3*o* and 3*u*. In general, the shapes shown in FIGS. 3*k* to 3*o*, where the sleeve 10 of the filaments is everted gradually at two or more corners and thus in a less acute angle, are more preferable, from the viewpoint of the smooth withdrawal of the sleeve 10, than the conical shapes in FIGS. 3 *i*, 3*j* and 3*u* where the sleeve 10 is turned inside out in one sharp turn. Furthermore, the spindles having a stepwise projection, such as the ones shown in FIGS. 3*m* to 3*o* have been found by experiments to be superior to the spindles without a projection, shown in FIGS. 3*k* and 3*l*. The probable reason for this phenomenon is the decrease in the contacting area between the sleeve 10 and the spindle surface at the extended end portions of the spindles which have a projection, the decrease in the contacting area facilitating the easier withdrawal of the sleeve 10.

Figure 4:
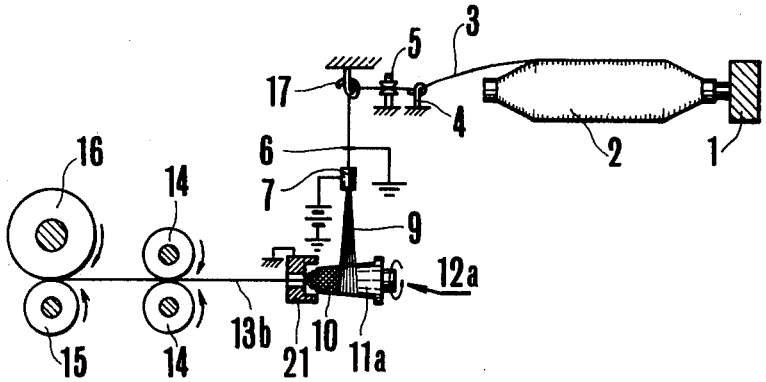
FIG. 4 is an end view, partially in section, of still another embodiment of the invention which is similar to the embodiment shown in FIG. 1 but in which a balloon controller is positioned closely adjacent to the spindle and a conical tubular sleeve of the filaments is axially withdrawn through a passage contained in the controller.
Figure 5:
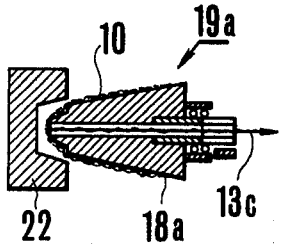
FIG. 5 is an enlarged cross-sectional view of the spindle in FIG. 2 but with a balloon controller provided closely adjacent to the spindle, a sleeve of filaments being everted at the spindle nose under the influence of the controller.

FIG. 4 shows an embodiment similar to that shown in FIG. 1 except that a balloon controller 21 is positioned closely adjacent the nose of the spindle. The balloon controller 21 has a recess with a passage therethrough and is adapted to physically control the movement of a filament balloon which tends to grow in the vicinity of the spindle nose and to depress the same against the spindle axis. The sleeve 10 on the spindle surface 11a is withdrawn through the passage formed in the balloon controller 21 and is taken up as a textured yarn 13*b*. The filament layers which continuously accumulate on the spindle surface 11*a* form a tubular sleeve 10 which is gradually withdrawn in the axial direction toward the nose of the spindle. Due to the ever-decreasing diameter, however, the sleeve 10 has slack in the vicinity of the spindle nose where some filaments, under the influence of the centrifugal force which is engendered by the rapid rotation of the spindle, form a balloon. The occurrence of ballooning depends on various factors including the diameter and the angle of inclination of the spindle, the condition of the spindle surface, and the type, denier and the filament number of the supplied multi-filament yarn. Once formed, the balloon will violently swing around and will accumulate near the spindle nose and be withdrawn only intermittently, resulting in an irregular yarn. Hence, the provision of a balloon controller is desirable for the purposes of improving the product quality and stabilizing the operation. The balloon controller can have any shape which enables close contact with a filament balloon which may be developing in the vicinity of the spindle nose to check the growth of the same. A good example is a balloon controller of the type shown at 21 in FIG. 4 which has a recess and is used in combination with a spindle which has a stepwise projection, such as the ones shown in FIGS. 3*e* and 3*h*. A balloon which has rapidly grown in the vicinity of the stepwise projection of the spindle in such a system will immediately contact the balloon controller 21 which urges the balloon to spirally depress toward the spindle axis and to be smoothly withdrawn through the passage formed in the controller 21. FIG. 5 shows an example wherein a balloon controller 22 with a recess is positioned closely adjacent a hollow conical spindle 19*a* of the type shown in FIG. 3*o* which has at the nose thereof a stepwise projection. The spindle 19*a*, furthermore, has an axially extending passage through which a sleeve 10, which has been everted at the spindle end, is withdrawn. As in the example shown in FIG. 4, a balloon which has grown at the nose of the spindle is immediately checked by the balloon controller 22, the balloon being forced to radially depress and evert smoothly. There is no special limitation on the suitable shape of the balloon controller. The controller should, however, be symmetrical with respect to the axis of rotation of the spindle in order to maintain a balanced contact with a balloon. Also, a balloon controller having a cylindrical recess, such as the controller 21 in FIG.. 4 and the controller 22 in FIG. 5, is particularly desirable for maximizing the frequency of contacts with the balloon and minimizing the probability of damage to the same. A fixed and non-rotary balloon controller will be desirable for structural simplicity. However, the controller may be designed to rotate at a desired speed. In such a case, the controller should not rotate at the same speed as the spindle and the direction of rotation should preferably be the same as the spindle for control efficiency.

Figure 6:
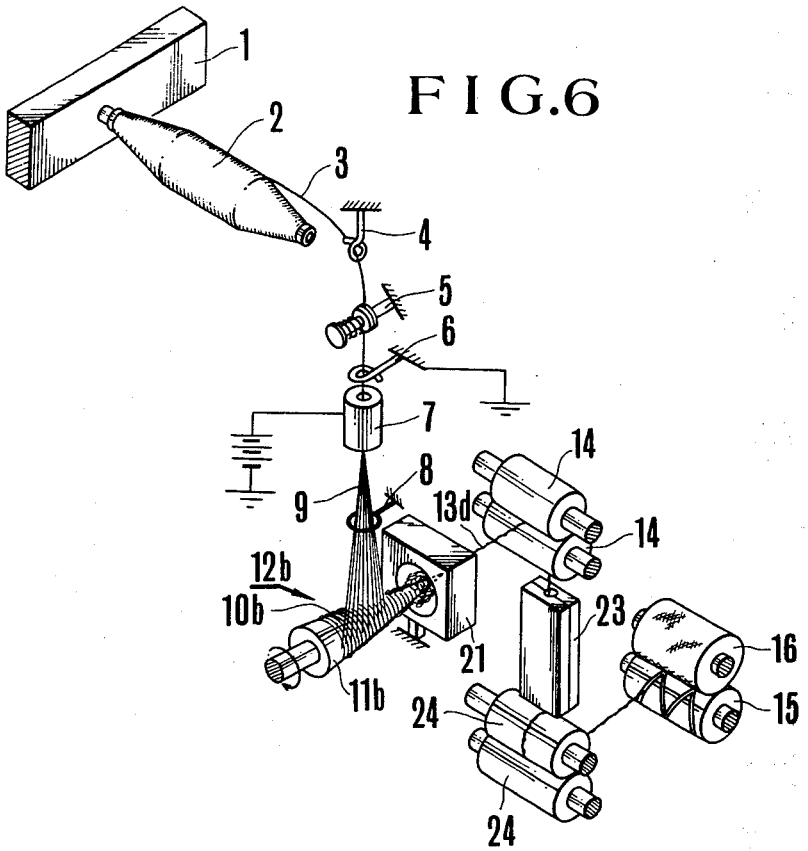
FIG. 6 is a schematic perspective view of a still further embodiment of the invention, which is similar to the embodiment of FIG. 1, showing the manner in which yarn is withdrawn from the spindle in the forward direction through a balloon controller and subsequently through an electrical heater.

FIG. 6 shows an embodiment similar to that in FIG. 4 except that the textured yarn 13*d* which has been pulled out by the paired nip rollers 14 subsequently undergoes a continuous heat treatment while passing through a heater 23 which is positioned between the pair of nip rollers 14 and another pair of nip rollers 24. The heat treatment will reduce residual shrinkage and the snarling characteristic of the textured yarn to a desired level. A suitable means for heating the advancing textured yarn includes an electric heater, a radio frequency wave heater and a steam heater. An alternative method for heat-treating the yarn is to steam-set the same in an autoclave after the yarn is collected on the package 16 or after the collected yarn is rewound on another bobbin with a slightly smaller diameter. A textured yarn manufactured according to the present invention has the advantage, even without the heat treatment, that it has a lower snarling characteristic than an ordinary twisted multi-filament yarn of like denier and a like number of twists, the reason for the phenomenon being unknown. Thus, the inclusion of the heat treatment step as shown in FIG. 6 further enhances the just discussed advantage of the textured yarn manufactured according to the method of the invention.

Further embodiments of apparatus for manufacturing a core yarn in accordance with the invention will now be described.

Figure 7:
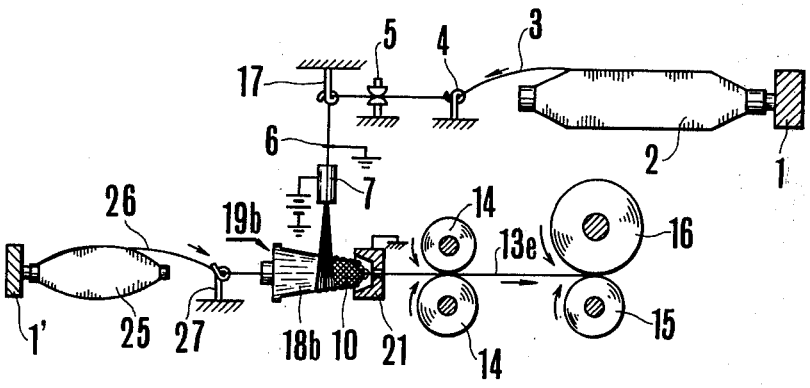
FIG. 7 is an end view similar to FIG. 4, of an embodiment in which a core thread is introduced from an additional package through an axially extending passage in the conical spindle and to the spindle nose to join the sleeve, the core thread and the enwrapping sleeve being collected as a core yarn.

Referring to FIG. 7, a tubular sleeve 10 which enwraps the hollow conical spindle 19*b* is withdrawn toward the nose portion of the spindle where there is a stepwise projection. Now, unlike the embodiment shown in FIG. 4, a core thread 26 is additionally introduced from a package 25 which is supported by the beam 1'. The core thread 26 is passed through a pigtail guide 27, through the axially extending passage formed in the hollow spindle 19*b* and within the sleeve 10 at the nose of the spindle. The core thread 26 is enwrapped by the sleeve 10. The core yarn 13*e* thus obtained is withdrawn through a passage formed in the balloon controller 21 under the pulling action of the nip roller 14, and subsequently taken up on a package 16.

The core yarn 13*e* manufactured by the method just described has some notable advantages. For instance, the sheath which wraps the core thread 26 of the yarn 13*e* has a sufficient network of filaments with genuine twists even when the doubling number (feed speed of the multi-filament yarn/delivery speed of the product) of the continuous multi-filament yarn is below 20 since the diameter of the spindle 19*b* can be kept small. When the doubling number is small, the sheath filaments will not cover the surface of the core thread 26 entirely, that is, the resultant core yarn 13*e* will have some surface characteristics which are those of the core thread 26. Thus, when the core thread and the sheath filaments have different colors, the core yarn product will have traces of both colors. Furthermore, when the core thread is made of metallic fiber or other electroconductive material, the product will have a conductive surface even if the sheath filaments happen to be insulating material. In general, a conductive yarn is required to have a conductive surface and the aforementioned characteristic of the yarn manufactured by the method of the invention will become an advantage. Particularly, a core yarn manufactured by wrapping a core thread of metallic fiber with a sheath of synthetic fiber filaments in the manner just described will find wide use for garment and interior decoration purposes in which the condutive nature of the material may be specially required.

Suitable materials for the core thread for use in the method of the invention will include vegetable fiber, animal fiber, mineral fiber, regenerated fiber, semisynthetic fiber, synthetic fiber, and any inorganic fiber including metallic fiber, glass fiber and carbon fiber. Furthermore, the core thread may be in any physical form as long as it is in a yarn configuration, namely, a spun yarn, multi-filament yarn, monofilament yarn, textured filament yarn, core yarn, plied yarn and a composite yarn having both filament and staple fiber.

Figure 8:
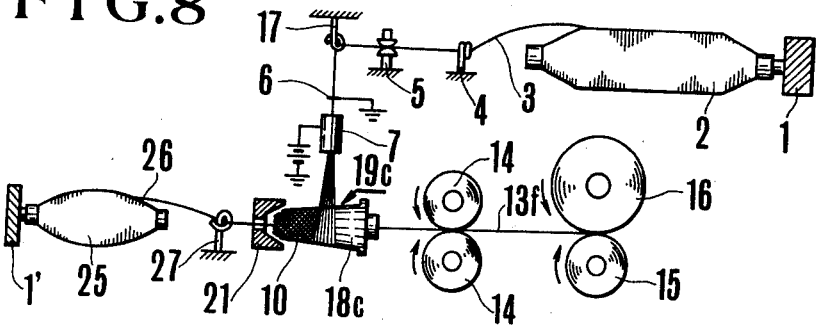
FIG. 8 is an end view, partially in section, of still another embodiment of the invention, which is similar to the embodiment of FIG. 5 but in which a core thread is additionally supplied through the balloon controller to the nose of the spindle, is joined with the sleeve which is being everted, enveloped in the sleeve and collected as a core yarn.

FIG. 8 shows an embodiment similar to that shown in FIG. 5 except that the core thread 26 is introduced from a package 25 through a pigtail guide 27, and through the passage which is formed in the balloon controller 21 to the nose of the spindle, where the filament sleeve 10 is being everted and withdrawn into the axially extending passage of the spindle. The package 25 which supplies the core thread 26 is supported on the beam 1'. As in the embodiment shown in FIG. 5, the balloon controller 21 is positioned closely adjacent the nose of the spindle and has on the spindle side thereof a recess for checking the growth of a filament balloon. At the nose of the spindle, the core thread 26 is enwrapped by the sleeve 10, which is being everted, and is withdrawn together with the sleeve through the passage which is formed in the spindle under the pulling action of the paired nip rollers 14 and collected on a package 16 as a finished core yarn 13*f*. The core yarn obtained by the process just described has fewer loops projecting from the yarn surface than the core yarn obtained by the embodiment shown in FIG. 7 because any filament balloon which has been formed in the former is turned inward and embedded in the sheath during the process of eversion.

Figure 9:
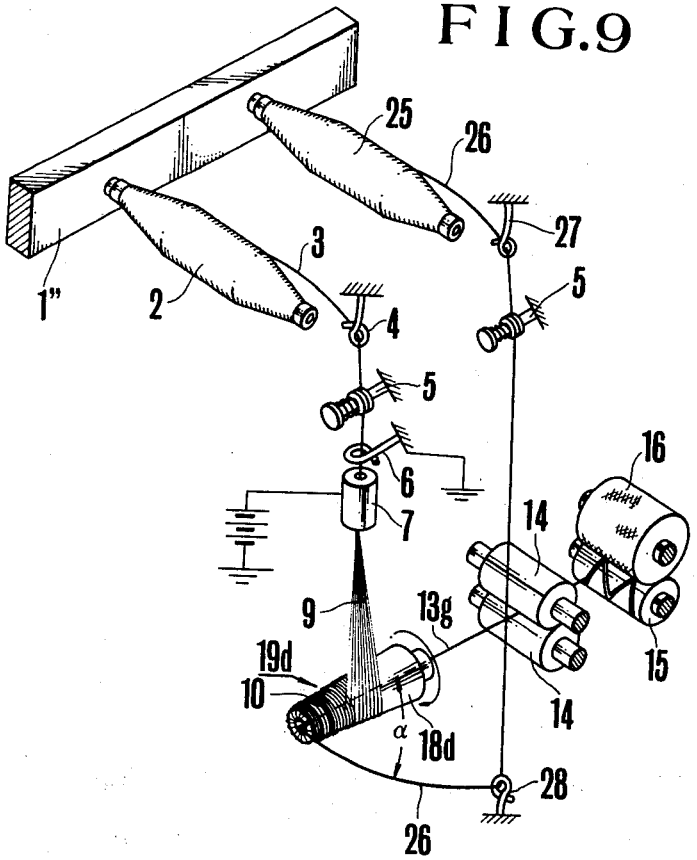
FIG. 9 is a schematic perspective view of a further embodiment of the invention, which is similar to the embodiment of FIG. 2 but in which a core thread is additionally supplied to the spindle nose at an angle of less than 90° with respect to a yarn being taken up.

Referring to FIG. 9 showing still another embodiment of the invention, the core thread 26 is supplied to the nose of the spindle at an angle of less than 90° with respect to the spindle axis, the angle being measured between the core thread and the core yarn 13*g* being delivered along the spindle axis. By so arranging the core thread supply, it is possible to effectively check the growth of the filament balloon, in this particular case by the contacting action of the core thread 26, and lead the sleeve 10 which envelops the spindle surface 18*d* smoothly into the passage formed in the spindle, and thus to produce a core yarn 13*g* of a substantially uniform quality efficiently and without resorting to the balloon controller 21 as shown in FIG. 8. In FIG. 9, reference numerals 27 and 28 denote pigtail guides. While the balloon controller 21 in the embodiment shown in FIG. 8 acts only to restrict the action of the balloon, the core thread 26 in the embodiment of FIG. 9 additionally acts to lead the balloon as well as the sleeve 10 into the axially extending passage of the spindle 19*d*, thereby assisting smooth eversion of the sleeve and greatly contributing to the improvement of product quality and operating efficiency.

Figure 10A:
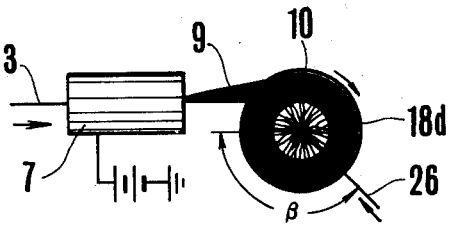
FIG. 10*a* is an enlarged elevational view of the rotating conical spindle and the apparatus for spreading filaments shown in FIG. 9.
Figure 10B:
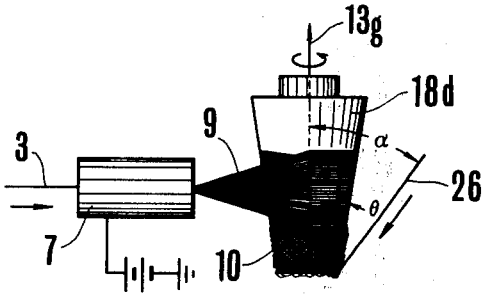
FIG. 10*b* is a plan view of the apparatus shown in 10*a;*

In order to take advantage of the balloon controlling action just discussed, a proper selection of the angle of the core thread supply will become an important consideration. The angle $\alpha$ as shown in FIG. 9, and in more detail in FIG. 10*b*, is measured between the direction of supply of the core thread 26 and the direction of withdrawal of the product core yarn 13*g*. From the viewpoint of controlling a balloon as soon as it has appeared, the angle should be as small as possible. When a spindle of a smaller diameter is employed to increase the twists in the finished yarn, and in turn, to step up the production rate, furthermore, a balloon controller will become incapable of sufficiently controlling the growth of a balloon. It will thus become particularly desirable to supply the core thread at an angle of $\alpha$ which is as small as feasible, and the angle $\alpha$ will certainly not exceed 90°. On the other hand, if the angle $\alpha$ becomes too small and comes too near to the angle $\theta$, the inclination of the spindle, there will be an increasing probability of the core thread 26 being entangled with the bundle 9 of the spreadout filaments or being wound around the spindle surface 18*d* in association with the filaments. Such an incident will disturb the proper formation of the sleeve 10 and will hinder the withdrawal of the same, resulting in yarn breaks. In order to avoid the trouble just discussed, the core thread supply angle $\alpha$ should be at least 5° larger than the angle of inclination $\theta$ of the spindle. Referring to FIG. 10 *a*, another supply angle $\beta$ of the core thread 26 is measured counterclockwise from a line passing through the spindle axis, which line is parallel to the direction in which the filament bundle 9 is supplied to the spindle. There is no special limitation on this angle $\beta$, although an angle almost approaching 0° should naturally be avoided to prevent operational difficulties and reduction in the regularity of the product yarn.

Figure 11:
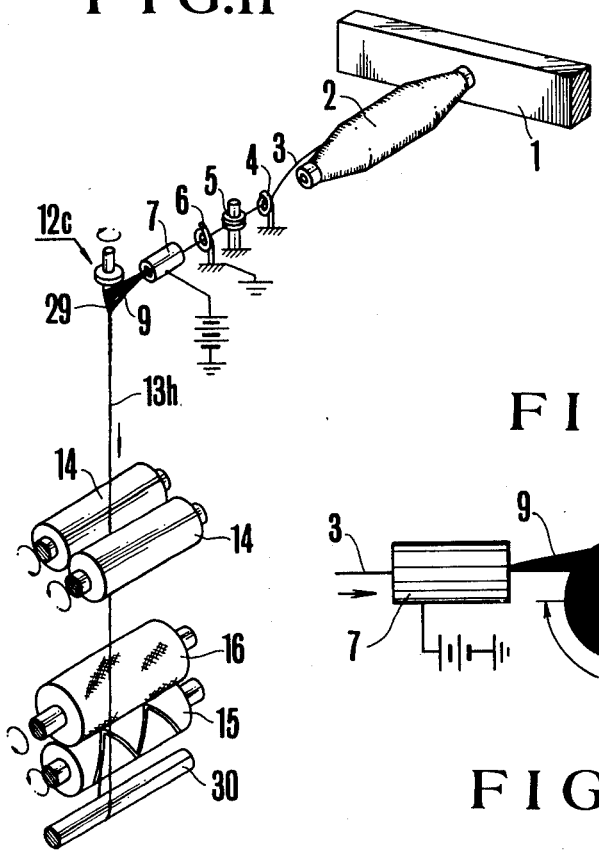
FIG. 11 is a schematic perspective view of a still further embodiment of the invention, which is similar to the embodiment shown in FIG. 1 but in which part of the spread filaments are supplied to a space just in front of the spindle nose to directly enwrap the yarn which is being taken up.

Referring to FIG. 11 showing another embodiment of the invention, the continuous multi-filament yarn 3 of artificial fiber, after being released from the package 2 which is supported by the beam 1, is passed through the pigtail guide 4, the tensioning device 5, and through the pigtail guide 6 to the electric filament spreading unit 7. The yarn 3 which has been spread out into the bundle of filaments at the spreading unit 7 then has part of the spread-out filaments passed onto the spindle surface. The balance of the filaments are passed to a space in front of the spindle to enwrap the sleeve which is being rotatingly drawn off from the nose of the spindle. The sleeve is formed on the spindle surface by continuous accumulation of that portion of the filaments bundle which are passed to the spindle to enwrap the same.

The product yarn 13*h* which is formed in the manner just described is given a kind of dual-layer structure with the sleeve portion substantially forming the core part and the filaments which have been passed to the space in front of the spindle constituting substantially the sheath part, although the boundary between the two layers is not clearly apparent in the product. The finished yarn 13*h* is continuously and positively fed by the pair nip rollers 14, then by a guide rod 30 along a bent path and is then collected on the package 16 which is in contacting engagement with and driven by the drum 15 having a traverse mechanism.

In a continuous multi-filament yarn of synthetic fiber, when its component filaments are spread apart by some means, rapid interchange of positions takes place among the individual filaments of the bundle as has already been discussed. There will be repeated alternations between the filaments which fall on the spindle surface and the filaments which advance to the space in front of the spindle. In other words, each filament of the product yarn will go into and out of the core region and the sheath region. As a result, a yarn manufactured by the method just described while possessing a bulky texture with a sheath full of loose filament loops will have a sheath which is closely interknit with the core region by the common filaments. Furthermore, by passing part of the yarn filaments directly onto the sleeve which is already off the spindle, it is possible to reduce the number of filaments which make contact with the spindle surface and thus assist smooth withdrawal of the sleeve. This will be a substantial advantage from the viewpoint of reducing the irregularities in the product yarn and in making possible stable yarn production with a low doubling number.

Figure 12A:
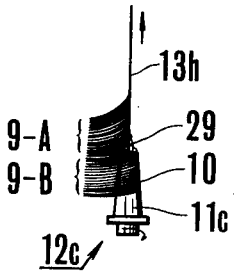
FIGS. 12*a* and 12*b* are enlarged end views schematically showing the spindle of FIG. 11.
Figure 12B:
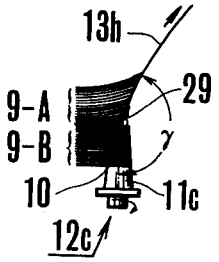
Figure 12C:
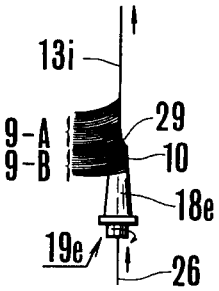
FIGS. 12*c* and 12*d* are views similar to FIGS. 12*a* and 12*b*, respectively, but with a core additionally introduced through an axially extending passage in the spindle.
Figure 12D:
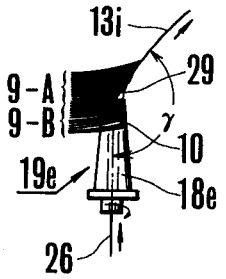

FIGS. 12*a* to 12*e*, inclusive, are enlarged views showing schematically various manners in which the filament bundle 9 of the multi-filament yarn can be passed onto the spindle surface 11*c* or 18*e* and to the space in front of the spindle. In the figures, shown at 9-B is that portion of the filament bundle 9 which falls on the spindle surface to enwrap the same in the form of a tubular sleeve 10 and shown at 9-A is the remainder of the filament bundle 9, which is passed to a sleeve 29 which is an extension of the sleeve 10 which has already advanced off the forward end of the spindle. The filaments 9-B which form the sleeve will form in association with the filaments 9-A a yarn 13*h* (13*i*) having a dual-layer structure. Referring to FIGS. 12*a* and 12*b*, the difference between the two examples is that the yarn 13*h* in the former is withdrawn in a direction substantially parallel to the axis of the spindle rotation while in the latter the yarn 13*h* is withdrawn at an angle $\gamma$ to the spindle axis. FIG. 12*c* is similar to FIG. 12*a* except that the spindle 19*e* in FIG. 12*c* is hollow and has an axially extending passage through which the core thread 26 is supplied from the hindmost part thereof into the focal point of the sleeve 29 which is being withdrawn to form the core yarn 13*i*. In FIG. 12*d*, the core yarn 13*i*, which is formed in the same manner as in FIG. 12*c*, is withdrawn at an angle $\gamma$ with respect to the spindle axis.

Of the examples shown in FIGS. 12*a* to 12*d*, those in FIG. 12*a* and 12*c* may be considered more reasonable and desirable, the yarns 13*h* and 13*i* being withdrawn along the spindle axis. Nevertheless, those shown in FIGS. 12*b* and 12*d* wherein the yarns 13*h* and 13*i* are withdrawn at an angle $\gamma$ which is less than 180° may be considered even more desirable because withdrawal of the conical tubular sleeve is even smoother at such an angle, thereby contributing to the improvement of operational efficiency. When the angle $\gamma$ approaches 90°, that is, when the take-up direction of the yarn becomes substantially perpendicular to the spindle axis, the force required to withdraw the sleeve becomes undesirably large. Needless to say, the withdrawal of the sleeve will become extremely difficult at an angle $\gamma$ smaller than 90°. The angle $\gamma$ therefore should not be less than 100° and preferably over 120°.

Figure 12E:
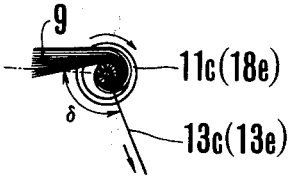
FIG. 12*e* is a schematic plan view of the spindle of FIG. 11.

Referring to FIG. 12*e*, the angle $\delta$ is the take-up direction of the yarn 13*c* (13*e*) as measured counterclockwise from the line which passes through the spindle axis and is parallel to the direction in which the filament bundle is supplied to the spindle surface. There is no special restriction on the angle $\delta$ except that at 0° (360°) the yarn which is being taken up tends to cross the filaments of the bundle 9. When the angle $\gamma$ is in the vicinity of 90° and $\delta$ is in the vicinity of 0°, the number of filaments 9-A which directly enwrap the yarn 13*c* (13*e*) tend to increase and the number of filaments 9-B which fall on the spindle surface 11*c* tend to decrease, increasing the probability that the bundle 9 of the spread filaments will slip off the spindle surface 11*c* and reducing the reliability of operation.

Figure 13:
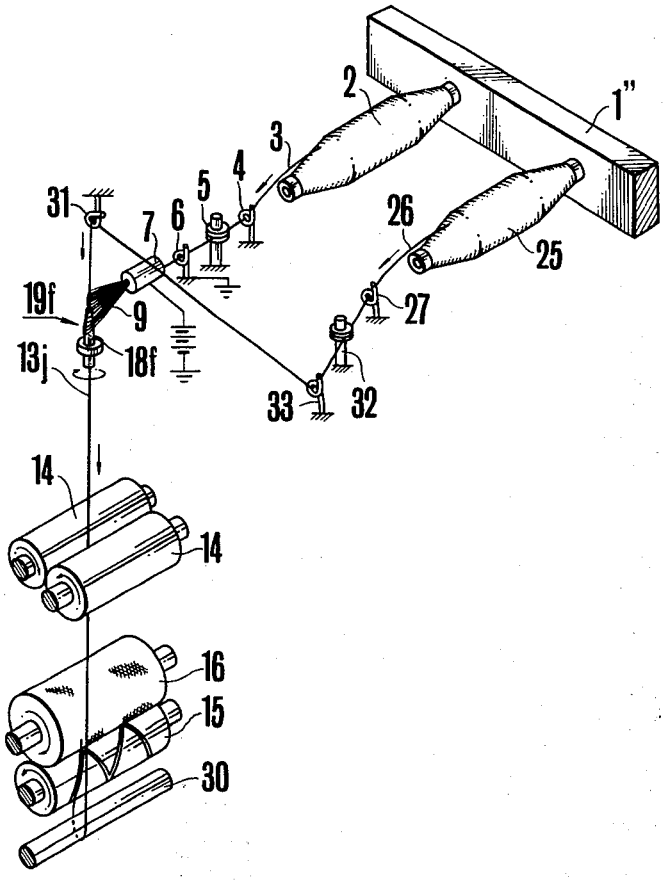
FIG. 13 is a schematic perspective view of still another embodiment of the invention, which is similar to the embodiment shown in FIG. 2 but in which a core thread is introduced to the spindle nose and part of the spread filaments are passed to a space just in front of the spindle nose to directly enwrap the core thread which is being supplied.

FIG. 13 shows an embodiment similar to that of FIG. 8, except that the balloon controller 21 of FIG. 8 is omitted. Instead, the filament bundle 9, which has been formed by spreading a continuous multi-filament yarn, has only part of the filaments thereof passed onto the surface 18*f* of the spindle 19*f* which has therein an axially extending passage and at the back portion thereof a flange. The remainder of the filament bundle 9 is passed to space just in front of the nose of the spindle to directly enwrap the core thread 26 which is being supplied toward the nose of the spindle in the axial direction. The filaments which fall on the spindle surface 18*f* enwrap the same in the form of the conical tubular sleeve 10. The sleeve 10 is progressively withdrawn toward the nose of the spindle, and everted at the spindle nose while simultaneously receiving therein the core thread 26 which has the surface thereof already enveloped in the remainder of the filaments. The sleeve 10 and the core thread 26 in association therewith are withdrawn in the backward direction through the passage of the spindle under the pulling action of the nip rollers 14, the withdrawal speed being less than the supply speed of the raw continuous multi-filament yarn 3. The yarn so obtained is collected on a package 16 as a core yarn 13*j* having a sheath with a substantially dual-layer structure.

The continuous multi-filament yarn 3 in the just discussed embodiment also has migration among the individual filaments. The filaments which directly enwrap the core thread 26 at one time will envelop the spindle surface 18*f* at another, and vice versa. Because of numerous repetitions of such an interchange in filament positions, the resultant core yarn 13*j* is given a dual-layer sheath which is bulky in texture but securely envelops the core thread with genuine twists, the two layers of the sheath having complicated and very closely interknit structures. For the reasons already given earlier, the core yarn 13*j* manufactured by the embodiment illustrated in FIG. 13 has fewer loose filament loops on the yarn surface than the core yarn 13*i* manufactured as in FIGS. 12*c* and 12*d*. The direction of supply of the core thread 26 should preferably coincide with the spindle axis as shown in FIG. 13, although there is no special reason to avoid some departure therefrom. As the direction of the core thread supply approaches 90°, however, the practical width of the spread filaments which are passed onto the core thread 26 is substantially reduced and the filaments tend to enwrap a shorter segment of the core thread 26 and in multiple layers at any given time. Such a phenomenon results in insufficient longitudinal distribution of the filaments in the sheath of the product core yarn 13*j*, reduction in the uniformity of the yarn, and a slight decrease in the resistance of the core yarn against abrasion. Any inclination in the direction of the core thread supply should not differ from the spindle axis excessively, the maximum allowable departure being approximately 30°.

Figure 14:
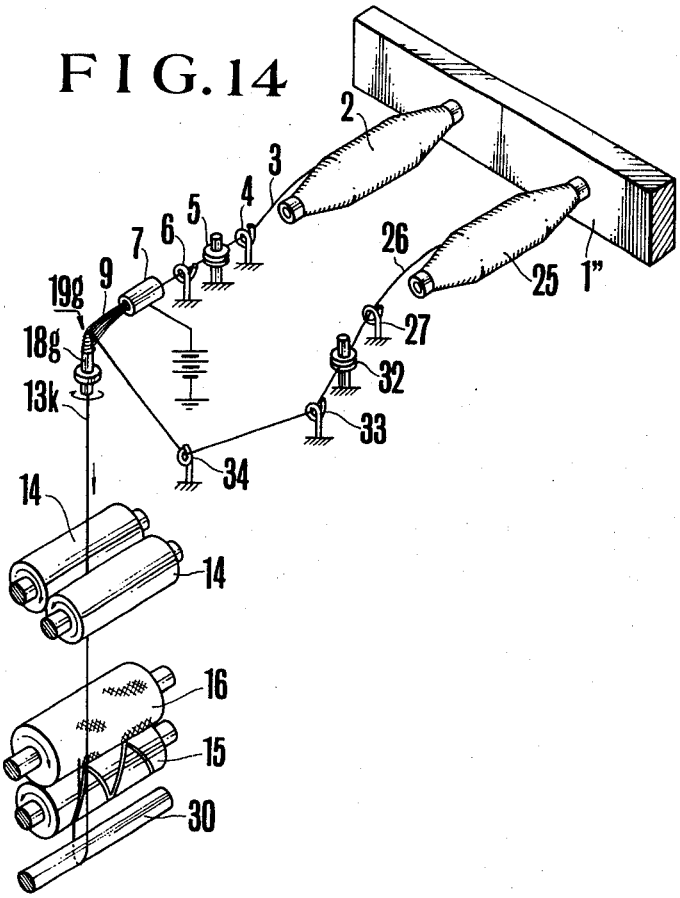
FIG. 14 is a view similar to FIG. 13 in which the core thread is supplied at an angle less than 90° with respect to the yarn take-up direction.
Figures 15A, 15B, 15C:
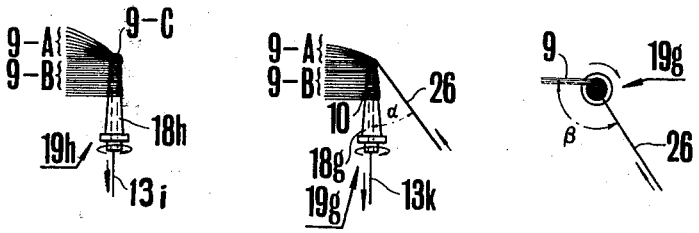
FIG. 15*a* is an enlarged schematic end view of the spindle in FIG. 14 but without a core thread.
FIG. 15*b* is a view similar to FIG. 15a but with a core thread.
FIG. 15*c* is an enlarged schematic plan view of the spindle of FIG. 15*b;*

In the embodiments shown in FIGS. 11 and 13, part of the spread-out filaments which have been passed to the space just in front of the spindle enwraps a yarn or a core thread which happens to be there. In the embodiment shown in FIG. 14, on the contrary, part of the filaments are passed to the space just in front of the spindle nose where there is nothing but the filaments themselves. Referring to FIG. 15*a* which shows in detail the spindle of the FIG. 14, the filaments 9-A are passed to the space in front of the spindle as if there were an imaginary spindle there. In the absence of such a spindle, in reality, the filaments 9-A are led directly to the nose of the spindle where there is an entrance to the axially extending passage.

The remainder of the filaments shown at 9-B, are passed onto the spindle surface 18*h* to form a conical sleeve. In the absense of the core thread 26, the filaments 9-A join the sleeve of the filaments 9-B at the spindle nose whereby the sleeve which is being everted will envelop the filaments 9-B. The yarn 131 so obtained has a dual-layer structure. In the process just discussed, however, a filament balloon 9-C tends to develop at the spindle nose, hindering the smooth withdrawal of the filaments into and through the passage of the spindle and resulting in a yarn somewhat inferior from the viewpoint of the yarn regularity. However, if the core thread 26 is introduced to the spindle nose at an angle $\alpha$ of not more than 90°, the angle being measured from the direction of withdrawal of the yarn 13*k*, as shown in FIGS. 14 and 15*b*, it will become possible to control the growth of the balloon 9-C just described, and to obtain satisfactory yarn regularity and the operational efficiency.

Figure 16:
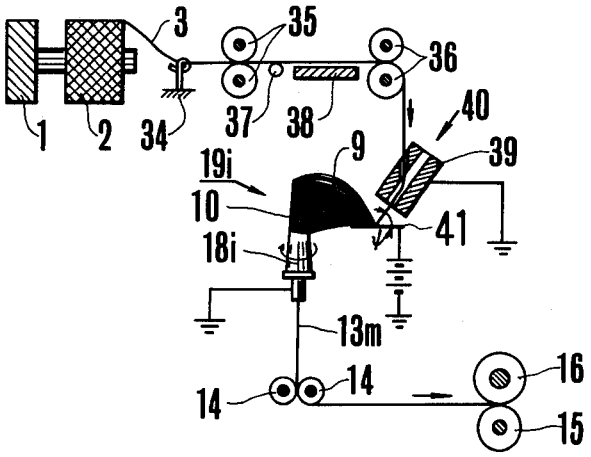
FIG. 16 is a schematic view, partially in section, of a further embodiment of the invention showing the manner in which a continuous multi-filament yarn is continuously drawn by drawing rollers, passed to an electrode of high potential, entrained in an ejected air flow, with the individual filaments spread out upon contacting the electrode, passed to and wound around the periphery of a rotating spindle, continuously withdrawn through a passage in the spindle and collected as a textured yarn by a wind-up means.

Referring to FIG. 16 which shows still another embodiment of the process of the invention, the package 2 which is supported by the beam 1 contains a continuous multi-filament yarn 3 of the type generally referred to as an undrawn yarn or a partially oriented yarn, which retains high residual elongation. After being released from the package 2, the yarn 3 is drafted to a predetermined denier while travelling between paired feed rollers 35 and paired draw rollers 36. This drafting section will additionally include a hot pin 37, a hot plate 38 and any other device such as a hot roller, and a steam jet nozzle, which are suitable for the particular kind of the undrawn yarn. The continuous multi-filament yarn so drafted is passed to an ejector 39 which is designed to suck in and eject the yarn by a flow of electrically non-conductive fluid 40. The yarn 3 and the fluid 40 are ejected from the ejector 39 under the pressure of the fluid toward a flat porous electrode plate 41 which is so positioned as to receive the fluid flow from the ejector 39 at an angle $\psi$ and on which is imposed a high voltage. The fluid 40 which has delivered the continuous multi-filament yarn 3 to the porous electrode plate 41 scatters when it hits the electrode, part of the fluid reaching the other side of the electrode through the small pinholes in the electrode while the remainder moves along bending paths generally toward the rotating spindle 19*i* and further scattering, carrying therewith the multi-filament yarn 3. Individual filaments of the continuous multi-filament yarn 3 receive electric charges of like polarity upon contacting the electrode plate 41. The electrostatic repulsion among the filaments spreads out the yarn 3 which is being carried by said remainder of the fluid in a substantially tensionless state to the spindle. Part of the filaments are attracted toward the electrically grounded nozzle of the ejector 39, some possibly reaching the same. The other filaments, while following slightly modified paths toward the spindle surface 19*i*, the paths being diverted toward the ejector 39. Eventually, all of the filaments are moved toward the rotating spindle 19*i* in a spread-apart and substantially tensionless state, some filaments directly falling on the spindle surface 18*i*, and enwrapping the same in the form of a tubular sleeve 10 which is gradually pulled toward the spindle nose. The sleeve 10 will be everted at the spindle nose and will constitute the sheath portion of a textured yarn 13*m*. The remainder of the filaments which did not fall on the spindle surface but are directed to space in front of the spindle nose act as if to enwrap an imaginary spindle and move directly into the axially extending passage formed in the spindle, the filaments being enveloped at the spindle nose by the sleeve 10 which is being everted, to become the core portion of the textured yarn 13*m*. The textured yarn 13*m* thus formed is withdrawn through the passage in the spindle under the pulling action of the nip rollers 14 and collected on the package 16 under the guidance of the drum 15. In the embodiment shown in FIG. 16 just described, the ejector 39 and the hollow spindle 19*i* are electrically grounded to act as electrodes which are opposite in polarity to the porous electrode plate 41 on which is imposed a high voltage. Alternatively, a grounded electrode having a suitable shape may be positioned at a location substantially along a line between the porous plate electrode 41 and the rotating hollow spindle 19*i*. In such a case, it is not necessary to ground the ejecting nozzle.

The feeding speed $Vf$ of the raw continuous multi-filament yarn is preferably greater than the peripheral speed $Vs$ of the spindle at a point where a line extended from the flat electrode surface crosses the spindle. In other words, the feed ratio $$\frac{(Vf - Vs)}{Vf} \times 100\%$$

should be greater than 0%, and preferrably between 2% and 20%. The reason for this is that if the feed ratio is less than 0%, the yarn which is being collected from the spindle surface becomes longer, or more stretched, than the raw yarn being fed. Under such a condition it will be difficult for the filaments of the yarn to divide or spread out because of the tension. With a feed ratio in the range 2 to 20%, the filament yarn will reliably contact the plate electrode 41, will be sufficiently spread out, and will securely enwrap the spindle surface before being everted and withdrawn. The textured yarn 13*m* so obtained will have closely interknit filaments and good resistance against abrasion.

With a feed ratio exceeding 20%, the filaments will be sufficiently spread out. Due to the relatively slower peripheral speed of the spindle, however, the sleeve formed on the spindle surface 18*i* will be slack and the textured yarn 13*n* which is produced will have reduced entanglement among filaments and many loose filament loops of larger sizes on the surface and the texture will be bulky. At a feed ratio of 40% or more, the formation of the filament sleeve on the spindle surface 18*i* will become unstable and the withdrawal of the sleeve will be difficult, often causing yarn breakage, a feed ratio in such a range being undesirable for practical use in the method of the invention.

The fluid which may be used in the ejector 39 should have sufficiently high electrical insulation properties to prevent short circuits between the electrodes. Generally, any of the gases are suitable for the purpose, although from handling, safety and economic considerations, air will be a natural choice. When air is used, a suitable pressure thereof will be in the range of 0.4 to 4.0 kg/cm$^2$. When the pressure is lower, it will be difficult to prevent the continuous multi-filament yarn from becoming entangled with the draw rollers. With a pressure above the given range, the individual filaments of the multi-filament yarn will be entangled with each other, thereby hindering the spreading of the filaments and thus disturbing the healthy sleeve formation.

The electrode shape may be flat, arcuate, or bent, there being no special restriction on shape, as long as it is porous. The filaments which are ejected from the nozzle are separated and spread out little by fluid of a relatively low pressure which has left the nozzle with the filaments. The porous electrode plate acts to separate the flaments from the initial fluid flow, change the direction of the filament travel and to give the electrical charge to the filaments, causing part of the fluid to be scattered while simultaneously causing the filaments to spread out gradually. In other words, the electrode gives an electric charge to the filaments coming into contact therewith while separating the filaments from the initial fluid flow. In order to carry out such objects, the electrodes must have numerous pinholes of such a diameter as to allow passage of the fluid but not the filaments. A suitable diameter of the pinholes and a suitable porosity of the plate depend on many factors such as the denier of the raw filaments, the feed rate, the shape of the electrode, the angle $\psi$ measured from the direction of the ejecting nozzle and the distance of the electrode from the nozzle. Nevertheless, a suitable electrode will desirably have pinholes of a diameter in the range of 0.2 to 1.2 mm and a porosity of 20 to 60%. The individual filaments which reach the electrode surface may slide slightly on the surface but should leave the surface almost immediately, and in the order of arrival, changing only the direction of travel toward the spindle surface 18*i*. During the course of passage to the spindle, the speed of the filaments will progressively increase. In order to fulfill the function just described, the angle $\psi$ (See FIG. 16) between the electrode and a line projecting from the ejection nozzle will have to be carefully selected, a suitable value for $\psi$ being in the range of 30° to 80°, and more preferably 50° to 75°. When the angle $\psi$ becomes less than 30°, the filaments will not make positive contact with the electrode and, furthermore, the filaments will be under a strong influence of the fluid flow which prevents sufficient spreading. When the angle $\psi$ becomes greater than 80°, likewise, the filaments will be held against the electrode under a strong air pressure, blowing more or less directly against the electrode. In such an instance, the filaments will become entangled with each other, form loops and be prevented from reaching the spindle. Even if the filaments do reach the spindle and withdrawal is possible, the yarn so obtained will not be of good quality.

It is feasible to supply a core thread to the spindle nose in the embodiment of FIG. 16. From the viewpoint of reducing the doubling-number and the operational stability, it may be desirable to introduce a core thread. Furthermore, the sleeve formed on the spindle surface 18*i* in the manner just described may be withdrawn in the forward direction without eversion as illustrated in FIG. 11, to form a core yarn accordingly.

The method of the invention essentially comprises the steps of spreading out a continuous multi-filament yarn and doubling the sread-out filament thereof on the spindle. The denier of the product yarn will, thus, always be greater than the denier of the raw multi-filament yarn. Therefore, the method of FIG. 16 which incorporates a drafting stage will be of special importance because it enables reduction in the denier of the textured yarn so that it is almost in line with the supplied multi-filament yarn.

Figure 17:
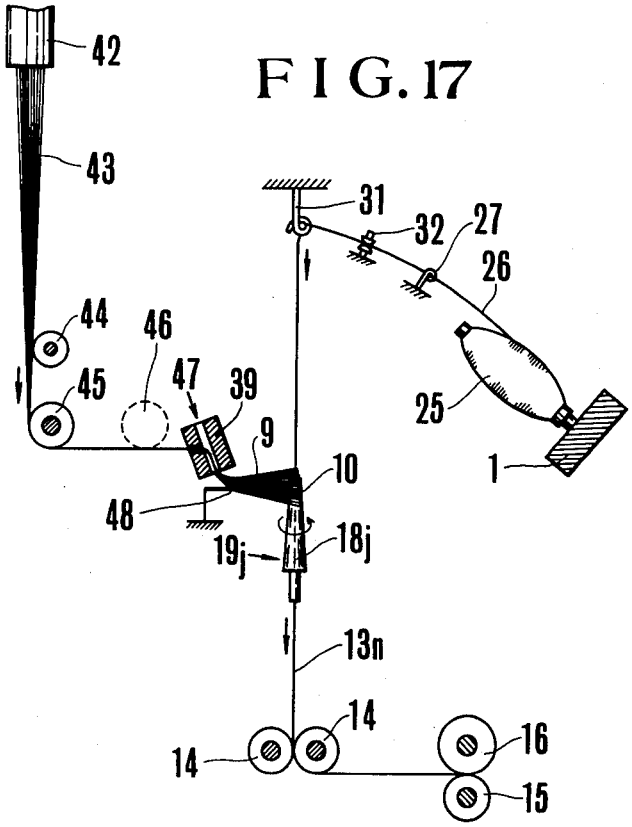
FIG. 17 is a schematic end view, partially in section, of a still further embodiment of the invention, showing the manner in which a freshly formed continuous multi-filament yarn is cooled and solidified, continuously fed by a godet roller, passed onto the periphery of the rotating spindle, entrained on an ejected air flow, simultaneously with the individual filaments being spread out in the course of their travel to the spindle, wrapped around the spindle surface and a core thread at the spindle nose, and continuously taken up as a core yarn on a wind-up means.

FIG. 17 shows still another embodiment of the invention, which incorporates a step of freshly extruding a continuous multi-filament yarn of a synthetic material into the method for manufacturing a textured yarn. Referring to the figure, a continuous multi-filament yarn 43 which is discharged from a spinning cylinder 42 is cooled and solidified before passing over the oiling roller 44 to receive spinning oil. The milti-filament yarn is subsequently fed at a predetermined speed by means of a godet roller 45 to an ejector 39. After being ejected from the ejector 39 together with the fluid, the continuous multi-filament yarn 43 comes in contact with a porous plate 48, slides on the surface of the same, and changes direction, and the filaments are led forward in substantially parallel paths while simultaneously allowing positional interchange among the filaments. At least part of the filaments of the continuous yarn 43 are passed onto the spindle surface 18*j* to enwrap the same in the form of a conical tubular sleeve, while the remainder of the filaments directly enwrap the core thread 26 which is being supplied from an additional package. Both parts of the filaments join together at the spindle nose to form a core yarn 13*n* which is collected on the package 16. In the embodiment of the invention just described, spreading of the filaments of the multi-filament yarn is carried out without the assistance of a high electric potential. Instead, the filaments are spread out under the influence of the fluid which is ejected from the ejector 39 and by the porous plate 48 which, while allowing some fluid to pass therethrough, forces the remainder of the fluid to change its path so as to flow along the surface thereof and to substantially scatter, thereby to bend and scatter the paths of the filaments. The method for spreading the filaments just described may be slightly inferior to the method additionally employing a high voltage effectiveness of spreading filaments and thus in producing yarn uniformity, but it certainly enjoys advantages in safety and capacity for high-speed operation. The fluid 47 does not have to be electrically non-conductive and may include almost any gas or liquid, although air will again be the best choice.

The non-electrical method of spreading individual filaments, which is used in conjunction with a freshly formed multi-filament yarn with little migration in the embodiment just given, may also be utilized for any substantially non-twist multi-filament yarn. A suitable pressure for the fluid will be slightly higher than that of the embodiment in FIG. 16 which additionally employed a high electric voltage. However, any excessive pressure will cause the filaments to be entangled with each other and form loops on the porous plate surface. The pressure must be sufficient to prevent sticking of the filament around the feed rollers, but otherwise should be as low as possible. The godet roller 45 shown in FIG. 17 is therefore absolutely necessary to feed the spun filament in the intermediate position, the godet roller 46, shown in broken lines, being additionally employed, depending on need, as a draw roller to reduce the residual elongation in the multi-filament yarn to suit the intended use of the yarn in a particular product, a particular type of the garmet, for instance.

EXAMPLE 1

A continuous multi-filament yarn of $20^d$–$12^f$ of polyester was processed by the embodiments of the invention as shown in FIGS. 1, 2, 4 and 5. The angle of inclination $\theta$ of the spindle surface was varied and the results analyzed, with or without a balloon controller, and with the balloon controller in both the stationary and rotating states. The doubling number was set at 15 in all the cases. Spindles of conical or cylindrical shape with a stepwise projection were used, the spindles having a diameter $D_1$ at the forward end of the main body of 14.5 mm and a diameter $D_2$ at the forward end of the projection of 8.5 mm (see FIG. 3). The spindles which were made of Bakelite, were rotatingly driven at a rate of 8,700 r.p.m. Furthermore, spindles of the type shown in FIG. 3*m* were used in the embodiment of FIG. 5. As a filament spreading apparatus, an electric system as disclosed in United State patent specification No. 3,657,871 was used at an electric potential of 4,500 volts. The results of experiments which were carried out under varied manufacturing conditions are summarized in Table 1. The desirable range of the angle of inclination $\theta$ was found to be 2° to 3.5°. In cases where the filament sleeve was withdrawn in the forward direction, rather than withdrawn in the backward direction after eversion, the withdrawal was smooth and the product yarn had better uniformity although the apparent texture of the yarn was inferior due to more loose filament loops sticking out from the yarn surface. Positioning of a balloon controller closely adjacent the spindle significantly improved various characteristics of the spindles with wider variation in surface inclination. Furthermore, the balloon controller functioned most effectively when it was driven rotatingly in the same direction as the spindle.

EXAMPLE 2

A texture yarn was manufactured by the embodiments of the process of the invention shown in FIGS. 7 to 9 under varied manufacturing conditions to be discussed below. Materials selected as a sheath component and a core thread were a continuous multi-filament yarn of $30^d$ to $12^f$ of polyester and a continuous multi-filament yarn of $100^d$–$24^f$ of polyester, respectively.

Table 2 summarizes how operating efficiency of the manufacture and quality of the product yarn change under varies dimensions $D_1$ and $D_2$ of the spindle, rotating speed $\omega$ of the spindle, take-up rates of the yarn and doubling number. As discussed with reference to Example 1, the diameter $D_1$ is measured at the forward end of the spindle main body and the diameter $D_2$ is measured at the forward end of the stepwise projection of the spindle. Throughout Example 2, the surface angle of inclination $\theta$ of the spindle was maintained at 2°. In the embodiment shown in FIG. 9, the angle $\alpha$ and angle $\beta$ were set, respectively, at 60° and 105°.

It will be clear from Table 2 that a spindle with a small diameter makes possible a reduction in the doubling number although it tends to increase the denier irregularity. When a core thread was supplied to the nose of the spindle at an angle of 60° as in FIG. 9, satisfactory operating efficiency and sufficiently good yarn regularity were ensured even with a small-diameter spindle and extremely small doubling numbers.

EXAMPLE 3

A core yarn was manufactured by the embodiments of the method of the invention shown in FIGS. 11, 12*c* and 12*d* using a continuous multi-filament yarn of $20^d$–$12^f$ of polyester as a sheath and a continuous multi-filament yarn of $50^d$–$21^f$ of polyester as a core thread. For the purpose of comparison, a core yarn was also manufactured in accordance with the procedure in FIGS. 2, 3 and 9, yarn regularity and other results being summarized in Table 3.

It will be apparent from Table 3 that the process of FIGS. 11, 12*c* and 12*d* wherein part of the spread-out-filaments are thrown into the space in front of the spindle nose while the remainder of the filaments enwrap the spindle surface in the form of a sleeve which is withdrawn in the forward direction, remarkably improves yarn regularity despite reduction in the doubling number. When a core thread was not employed, however, there was observed a slight decline in operational efficiency. When a core thread was employed, it was possible to further reduce the doubling number by selecting a cylindrical spindle, but at a cost of slight deterioration in yarn regularity. When a cylindrical spindle was used in conjunction with the embodiment in FIG. 11, it was not possible to withdraw the sleeve on the spindle surface continuously.

EXAMPLE 4

A core yarn was manufactured by the embodiments of the invention shown in FIGS. 13 and 14, using continuous multifilament yarns of $20^d$–$12^f$ and $30^d$–$12^f$ of polyester as sheath components, and a continuous multi-filaments yarn $100^d$–$24^f$ of polyester as a core thread. For the purpose of comparison, a core yarn was also manufactured using the embodiment of FIG. 9, the results being summarized in Table 4. The angle of inclination $\theta$ of the spindle was set at 2° throughout the example.

Operational efficiency was satisfactory under all the manufacturing conditions. Using the procedure illustrated in FIGS. 13 and 14, furthermore, a core yarn having excellent regularity was obtained at an extremely low doubling number, the core yarn resembling genuine spun yarns both in appearance and texture as well as in U%.

EXAMPLE 5

Following the procedures of the embodiment in FIG. 16, an undrawn continuous multi-filament yarn of $105^d$–$12^f$ of polyester was elongated 3.5 times in its travel through a drafting zone including a hot pin maintained at 80°c, a hot plate maintained at 100°C and paired draw rollers. The draw rollers fed the continuous multi-filament yarn to an ejector at a speed 4% in excess of the corresponding peripheral speed of the spindle. The yarn was ejected from the ejector together with relatively low-pressure air at 0.8 kg/cm² and led to a flat porous electrode plate (30 mesh, $\theta = 60°$) on which was imposed a potential of 7,000 volts. Upon contacting the electrode plate, the multifilament yarn had the path of travel thereof immediately bent and passed to a rapidly rotating (75,000 r.p.m.) hollow spindle while simultaneously having the filaments thereof gradually spread out. The spindle had a diameter ($D_1$) at the forward end thereof of 2.0 mm and an angle of inclination $\theta$ of 2°. Part of the spread-out filaments of the multi-filament yarn enwrapped the spindle surface in the form of a sleeve which was everted at the spindle nose. The remainder of the filaments directly enwrapped a core thread (not shown) at the space in front of the spindle. The core thread comprises a continuous multi-filament yarn of $100^d$ – $24^f$ of polyester. The core thread enveloped by said remainder of filaments joined at the spindle nose the sleeve of which was being everted. The entire structure was withdrawn through the axially extending passage of the spindle and was collected as a yarn having a substantially dual-layer structure. The yarn so obtained had a denier of 256 and a doubling number of approximately 5.2. The process gave excellent operational efficiency and a core yarn of small irregularity (U% = 18), at a take up speed of 150 meter/min.

EXAMPLE 6

A continuous polyester multi-filament yarn was freshly molten spun, cooled, solidified and supplied to a pair of godet rollers. By the co-operating action of the godet rollers, which rotated at a peripheral speed of 400 meters/min., and paired draw rollers further along the line, with a peripheral speed of 1,200 meters/min, the multi-filament yarn was elongated to three times its length during the course of its passage therebetween. The draw rollers continuously fed the yarn of an ejector at a rate exceeding the peripheral speed of a hollow spindle by 17%. Led by air at a relatively low pressure of 1 kg/cm², the yarn was brought into contact with a flat porous plate (30 mesh, $\psi = 0°$) and had the path thereof bent, together with some of the air, was directed toward a rapidly rotating spindle (100,000 r.p.m.). The particular spindle had a truncated conical shape with a diameter at the forward end thereof of 2.0 mm and an angle of inclination $\theta$ of 2°, and had an axially extending passage. Part of the filaments of the multi-filament yarn enwrapped the spindle surface in the form of a sleeve which was continuously withdrawn toward the nose of the spindle and everted at the nose. The remainder of the filaments were fed into the space just in front of the spindle nose to enwrap a core thread which was being supplied to the spindle nose along the spindle axis. The core thread was a false twisted nylon filament yarn of $100^d$–$36^f$. The enwrapped core thread joined the sleeve which was being everted and formed a core yarn with a sheath having a dual-layer type structure. At a take up speed of 133 meters/min., operating efficiency was satisfactory and the product yarn had a denier of 197 and a rather large U% of 27.

EXAMPLE 7

Following the procedure illustrated in FIG. 5, a continuous multi-filament yarn of $20^d$–$6^f$ of polyester and a continuous multi-filament yarn of $20^d$–$12^f$ of nylon 6 were continuously supplied to the surface of a hollow spindle as separate filament bundles from two independent electrical filament spreading devices. The spindle was of Bakelite and had a truncated conical shape with a stepwise projection at the nose, a diameter $D_1$ at the forward end of the main body of 8.6 mm, a angle of inclination $\theta$ of 2° and a rotational speed of 25,000 r.p.m.. The filaments enwrapped the spindle and formed a sleeve comprising successive layer of sheets of polyester and Nylon filaments. The potential of the electric filamentspreading unit was maintained at 4,500 volts. As shown in FIG. 5, a balloon controller was positioned clearly adjacent the spindle, the controller being fixedly positioned in the particular example. The sleeve formed in the manner just described was everted at the spindle nose and withdrawn through the passage in the spindle to form a textured yarn of denier 398 and a U% of 23. The doubling number was 10. The textured yarn was woven into a 2/2 twill weave using at 40's cotton yarn as the warp and treated in a dyeing bath containing both an acid dye and a dispersion dye. The nylon and polyester filaments were selectively dyed to different colors to give a frosty pattern to the weave. The dyed weave had a bulky texture and an appearance similar to that of a weave of 100% spun yarns.

The same procedure was followed, save for the manner of supplying filaments to the spindle. In this case, the yarns of Nylon and polyester were fed side by side to one electric filament-spreading apparatus so as to be supplied to the spindle surface as one filament bundle. The result was some irregularity in the spreading, which was observable in the product as variations in the yarn thickness. A textured yarn thus obtained was woven into a weave and dyed in the manner described above. The weave resembled a hand-woven textile in texture and color pattern and possessed promising fancy effects.

TABLE 1 (1)

| Sample No. | $\theta$ (degrees) | Balloon Controller | Rotation of Balloon Controller | Direction of Yarn Withdrawal | Breaking Stress (Gram/den) | Breaking Elongation (%) | U (%) | Comments |
|---|---|---|---|---|---|---|---|---|
| 1 | 0 | Not used | — | Forward | — | — | — | Sleeve impossible to withdraw. |
| 2 | | | | Backward | — | — | — | |
| 3 | 1 | " | — | " | 1.2 | 5.3 | 23 | Large pull required during sleeve withdrawal. |
| 4 | | | | | 1.8 | 7.8 | 25 | Yarn easily breakable. |
| 5 | 2 | " | — | " | 1.6 | 7.1 | 22 | Operating efficiency, yarn |
| 6 | | | | | 2.0 | 8.0 | 24 | regularity both satisfactory. |
| 7 | 3.5 | " | — | " | 1.6 | 7.3 | 23 | Operating efficiency, yarn |

TABLE 1 (1)-continued

| | | | | | | | | |
|---|---|---|---|---|---|---|---|---|
| 8 | | | | | 2.1 | 8.2 | 23 | regularity both satisfactory. |
| 9 | 5 | " | — | " | 1.1 | 5.9 | 30< | Operating efficiency fair to |
| 10 | | | | | 1.6 | 6.5 | 27 | slightly unsatisfactory. |
| 11 | 10 | " | — | " | — | — | — | Operating efficiency unsatisfactory. |
| 12 | | | | | — | — | — | |
| 13 | 15 | " | — | " | — | — | — | Continuous operation impossible. |
| 14 | | | | | — | — | — | |
| 15 | 20 | " | — | " | — | — | — | Spread-out filaments will not |
| 16 | | | | | — | — | — | enwrap spindle. |

TABLE 1 (2)

| Sample No. | θ (degrees) | Balloon Controller | Rotation of Balloon Controller | Direction of Yarn Withdrawal | Breaking Stress (Gram/den) | Breaking Elongation (%) | U (%) | Comments |
|---|---|---|---|---|---|---|---|---|
| 17 | 0 | Used | Fixed | Forward | — | — | — | Sleeve impossible to withdraw. |
| 18 | | | | Backward | — | — | — | |
| 19 | 1 | " | " | " | 1.8 | 7.9 | 21 | Large pull required during sleeve |
| 20 | | | | | 1.9 | 8.0 | 22 | withdrawal. |
| | | | | | | | | Yarn easily breakable. |
| 21 | 2 | " | " | " | 1.7 | 7.8 | 18 | Operating efficiency, yarn |
| 22 | | | | | 2.2 | 8.1 | 18 | regularity both satisfactory. |
| 23 | 3.5 | " | " | " | 2.0 | 8.0 | 17 | Operating efficiency, yarn |
| 24 | | | | | 2.4 | 8.3 | 17 | regularity both satisfactory. |
| 25 | 5 | " | " | " | 1.8 | 7.3 | 26 | Operating efficiency moderately satisfactory. |
| 26 | | | | | 1.8 | 7.0 | 24 | Irregular yarn. |
| 27 | 10 | " | " | " | 1.3 | 5.9 | 30< | Operating efficiency unsatisfactory. |
| 28 | | | | | 1.5 | 6.3 | 29 | |
| 29 | 15 | " | " | " | — | — | — | Continuous operation impossible. |
| 30 | | | | | — | — | — | |
| 31 | 20 | " | " | " | — | — | — | Spread-out filaments will not |
| 32 | | | | | — | — | — | enwrap spindle. |

TABLE 1 (3)

| Sample No. | θ (degrees) | Balloon Controller | Rotation of Balloon Controller | Direction of Yarn Withdrawal | Breaking Stress (Gram/den) | Breaking Elongation (%) | U (%) | Comments |
|---|---|---|---|---|---|---|---|---|
| 33 | 0 | Used | Rotation* | Forward | — | — | — | Sleeve impossible to withdraw. |
| 34 | | | | Backward | — | — | — | |
| 35 | 1 | " | " | " | 1.7 | 7.7 | 17 | Large pull required during sleeve withdrawal. |
| 36 | | | | | 1.8 | 8.2 | 19 | yarn easily breakable. |
| 37 | 2 | " | " | " | 1.9 | 8.1 | 15 | Operating efficiency, yarn |
| 38 | | | | | 2.6 | 8.5 | 14 | regularity both satisfactory. |
| 39 | 5 | " | " | " | 1.7 | 7.2 | 24 | Operating efficiency, yarn |
| 40 | | | | | 1.9 | 7.6 | 19 | regularity both satisfactory. |
| 41 | 10 | " | " | " | 1.7 | 7.3 | 27 | Operating efficiency moderately satisfactory. |
| 42 | | | | | 1.8 | 7.5 | 24 | Irregular yarn. |
| 43 | 15 | " | " | " | — | — | 30< | Operating efficiency, |
| 44 | | | | | 1.7 | 6.3 | 28 | yarn regularity both fair to slightly unsatisfactory. |
| 45 | 20 | " | " | " | — | — | — | Spread-out filaments will not |
| 46 | | | | | — | — | — | enwrap spindle. |

*Rotational speed — 4,350 r.p.m., in the same direction as a spindle.

TABLE 2

| Sample No. | FIG. No. | $D_1$ ($D_2$) mm | Rotational Speed of Spindle ω r. p. m. | Yarn Take-up Speed S meter/min | Denier | Doubling Number | U % | Comments |
|---|---|---|---|---|---|---|---|---|
| 47 | 7 | | | | 613 | 17.0 | 17 | Operating efficiency highly satisfactory. |
| | | 14.5 | 9,000 | 25 | | | | Yarn regularity moderately satisfactory. |
| 48 | 8 | (8.0) | | | 610 | 17.0 | 17 | " |
| 49 | 9 | | | | 604 | 16.8 | 14 | Operating efficiency, yarn regularity both highly satisfactory. |
| 50 | 7 | | | | 445 | 11.6 | 21 | Operating efficiency satisfactory. Yarn regularity fair to slightly unsatisfactory. |
| | | 8.6 | 16,000 | 40 | | | | |
| 51 | 8 | (5.0) | | | 447 | 11.6 | 21 | " |
| 52 | 9 | | | | 440 | 11.3 | 18 | Operating efficiency highly satisfactory. Yarn regularity moderately satisfactory. |
| 53 | 7 | | | | 307 | 6.9 | 24 | Operating efficiency moderately satisfactory. Yarn regularity unsatisfactory. |
| | | 5.0 | 35,000 | 85 | | | | |
| 54 | 8 | (3.0) | | | 309 | 6.9 | 24 | Operating efficiency moderately satisfactory. Yarn regularity fair to slightly unsatisfactory. |
| 55 | 9 | | | | 309 | 6.9 | 19 | Operating efficiency highly satisfactory. Yarn regularity moderately satisfactory. |

TABLE 3

| Sample No. | FIG. No. | Core Thread | θ (degrees) | γ (α) (degrees) | Denier | Doubling Number | U% | Comments |
|---|---|---|---|---|---|---|---|---|
| 56 | 2 | Used | 2 | — | 184 | 6.7 | 25 | Operating efficiency satisfactory. Yarn regularity fair to slightly unsatisfactory. |
| 57 | 4 | " | 2 | — | 178 | 6.4 | 24 | " |
| 58 | 9 | " | 2 | −(90) | 180 | 6.5 | 22 | Operating efficiency satisfactory. Yarn regularity moderately satisfactory. |
| 59 | 11 | — | 2 | — | 100 | 5.0 | 21 | Operating efficiency moderately satisfactory. Yarn regularity moderately satisfactory. |
| 60 | 12 c | Used | 2 | 180 | 152 | 5.1 | 19 | Operating efficiency satisfactory. Yarn regularity satisfactory. |
| 61 | 12 c | " | 0 | 180 | 142 | 4.6 | 23 | Operating efficiency satisfactory. |
| 62 | 12 d | " | 0 | 120 | 144 | 4.7 | 22 | " |

Shape of spindle - conical, diameter at the forward end 2.0 mmϕ(Sample Nos. 56 to 60) - cylindrical, diameter 2.0 mmϕ (Sample Nos. 61 and 62)
Rotational speed of spindle - 50,000 r.p.m.
Take-up speed - 90 m/min.

TABLE 4

| Sample No. | Fig. No. | Denier of Sheath Yarn | ω (r.p.m.) | Take-up Speed S m/min. | mmϕ $D_1(D_2)$ | α (degree) | β (degree) | Denier | Doubling Number | U% | Comments |
|---|---|---|---|---|---|---|---|---|---|---|---|
| 62 | 9 | $30^D$ | 35,000 | 85 | 5.0(3.0) | 60 | 105 | 316 | 7.2 | 19 | Operating efficiency satisfactory. |
| 63 | 13 | $30^D$ | " | " | " | 180 | — | 283 | 6.1 | 16 | " |
| 64 | 14 | $30^D$ | " | " | " | 60 | 105 | 283 | 6.1 | 15 | " |
| 65 | 9 | $20^D$ | 50,000 | 110 | 2.0 | 60 | 105 | 192 | 4.6 | 18 | " |
| 66 | 13 | $20^D$ | " | " | " | 160 | 105 | 176 | 3.8 | 15 | " |
| 67 | 13 | $20^D$ | " | " | " | 180 | — | 174 | 3.7 | 14 | " |
| 68 | 14 | $20^D$ | " | " | " | 60 | 105 | 176 | 3.8 | 14 | " |

What is claimed is:

1. A method for manufacturing a textured yarn, comprising the steps of: passing at least one continuous multi-filament yarn of artificial fiber to a rotating spindle from a fixed point while simultaneously spreading said multi-filament yarn into individual filaments; wrapping at least part of said filaments around said spindle in the form of a sleeve; continuously withdrawing said sleeve along the spindle axis at a speed lower than the feed speed of said multi-filament yarn; and collecting the yarn thus obtained in an orderly manner.

2. A method for manufacturing a textured yarn as claimed in claim 1, wherein said at least one continuous multi-filament yarn has therein at least one synthetic fiber selected from the group consisting of nylon, polyester, acrylic, benzoate, polyvinyl alcohol, polypropylene, polyvinyl chloride, polyethylene and polyvinylidene chloride.

3. A method for manufacturing a textured yarn as claimed in claim 1 wherein said at least one continuous multi-filament yarn has therein at least one semisynthetic fiber selected from the group consisting of acetate, triacetate and protein-acrylonitrile co-polymer.

4. A method for manufacturing a textured yarn as claimed in claim 1, wherein said at least one continuous multi-filament yarn has therein at least one regenerated fiber selected from the group consisting of rayon, viscose and cupra.

5. A method for manufacturing a textured yarn as claimed in claim 1, wherein said sleeve which enwraps said spindle is everted at the nose of the spindle and withdrawn through an axial passage in said spindle.

6. A method for manufacturing a textured yarn as claimed in claim 1, wherein a core thread is introduced into the nose of the spindle to be enveloped by the sleeve being withdrawn therefrom.

7. A method for manufacturing a textured yarn as claimed in claim 6, wherein said sleeve in everted at the nose of the spindle and withdrawn through an axial passage in said spindle, and said core thread is introduced into the nose of said spindle from a direction at an angle of not more than 90° with respect to the spindle axis in the direction of the yarn withdrawal, said core thread being enveloped at said nose in said sleeve undergoing eversion.

8. A method for manufacturing a texture yarn as claimed in claim 6, wherein the core thread is of electrically conductive fiber.

9. A method for manufacturing a textured yarn as claimed in claim 1, wherein said sleeve which enwraps said spindle is drawn off over the nose of the spindle.

10. A method for manufacturing a textured yarn as claimed in claim 9, wherein said spindle has therein an axially extending passage and a core thread is introduced through and from hindmost part of said axial passage to the nose of the spindle within said sleeve which is being withdrawn from the spindle to be wrapped therein.

11. A method as claimed in claim 10, wherein said textured yarn is withdrawn from said spindle at an angle of from 90° to 180°, inclusive, with respect to the spindle axis in the direction of the yarn withdrawal, said core thread being enveloped at said nose in said sleeve being withdrawn.

12. A method for manufacturing a textured yarn as claimed in claim 1, wherein said spindle around which at least part of said spread filaments are wound has a conical shape tapered toward the nose, at an angle of inclination of not more than 15°.

13. A method for manufacturing a textured yarn as claimed in claim 1, wherein said spindle around which only part of said spread filaments are wound has a cylindrical shape with an angle of inclination of 0°.

14. A method for manufacturing a textured yarn as claimed in claim 1, wherein said continuous multi-filament yarn comprises ten or more mono-filaments.

15. A method for manufacturing a textured yarn as claimed in claim 1, wherein said continuous multi-filament yarn of artificial fiber is spread into individual filaments by an apparatus which comprises a pair of electrodes having a potential difference of at least 500 volts.

16. A method for manufacturing textured yarn as claimed in claim 1, wherein said continuous filaments is spread into individual filaments by an ejector adapted to positively eject said multi-filament yarn together with a fluid flow against a porous plate.

17. A method for manufacturing a textured yarn as claimed in claim 16, wherein said porous plate is charged to a potential difference of at least 500 volts with respect to said ejector and said spindle, and said fluid is substantially electrically nonconductive.

18. A method for manufacturing a textured yarn as claimed in claim 1, wherein said continuous multi-filament yarn to be spread into individual filaments is an artificial fiber extruded from a spinning solution, cooled and then solidified.

19. A method for manufacturing a textured yarn as claimed in claim 1, wherein said continuous multi-filament yarn of artificial fiber is unwound from a package and subjected continuously to a drafting treatment, before being spread into individual filaments.

20. A method as claimed in claim 19 wherein said filament yarn is further subjected to a heat treatment before being spread into individual fibers.

21. A method for manufacturing a textured yarn as claimed in claim 1, wherein all of said spread filaments from a continuous multi-filament yarn are wound around the spindle surface, and a balloon controller is positioned substantially in front of the spindle for the purpose of contracting a filament balloon by frictional contact therewith.

22. A method for manufacturing a textured yarn as claimed in claim 1, wherein the maximum diameter of said spindle, excluding any flange thereon, is not more than 25 mm.

23. A method for manufacturing a textured yarn as claimed in claim 1, wherein the ratio of the feed speed of said continuous multi-filament yarn and the take up speed is in the range of 3 to 20.

24. A method for manufacturing a textured yarn as claimed in claim 1, wherein only part of the spread-out filaments of said multi-filament yarn are passed to and wrapped around said rotating spindle in the form of a sleeve, and the remainder of the filaments are passed into the space in front of said spindle.

* * * * *